US008363082B2

(12) United States Patent
Schaffstein

(10) Patent No.: US 8,363,082 B2
(45) Date of Patent: Jan. 29, 2013

(54) SYSTEMS AND METHODS FOR ALIGNMENT OF LASER PRINTERS

(75) Inventor: Michael Joseph Schaffstein, Waltham, MA (US)

(73) Assignee: Conexant Systems, Inc., Newport Beach, CA (US)

( * ) Notice: Subject to any disclaimer, the term of this patent is extended or adjusted under 35 U.S.C. 154(b) by 557 days.

(21) Appl. No.: 12/539,526

(22) Filed: Aug. 11, 2009

(65) Prior Publication Data

US 2011/0037822 A1 Feb. 17, 2011

(51) Int. Cl.
*B41J 2/435* (2006.01)
*B41J 2/47* (2006.01)

(52) U.S. Cl. ..... 347/237; 347/247

(58) Field of Classification Search ..... 347/229, 347/234–237, 247–250
See application file for complete search history.

(56) References Cited

U.S. PATENT DOCUMENTS

| | | | | |
|---|---|---|---|---|
| 2,841,328 | A | | 7/1958 | Steele et al. |
| 2,923,470 | A | | 2/1960 | Beck et al. |
| 2,924,381 | A | | 2/1960 | Eckdahl et al. |
| 3,027,078 | A | | 3/1962 | Steele |
| 3,029,023 | A | | 4/1962 | Beck et al. |
| 3,035,768 | A | | 5/1962 | Steele |
| 3,214,575 | A | | 10/1965 | Seliger et al. |
| 3,313,925 | A | | 4/1967 | Bible |
| 3,564,223 | A | | 2/1971 | Harris et al. |
| 3,590,231 | A | | 6/1971 | Wenzl |
| 3,633,002 | A | | 1/1972 | Dendy et al. |
| 3,670,154 | A | | 6/1972 | McMurray |
| 4,059,833 | A | * | 11/1977 | Kitamura et al. ..... 347/261 |
| 4,475,162 | A | * | 10/1984 | Kitamura ..... 345/443 |
| 4,885,594 | A | | 12/1989 | Eguchi |
| 5,239,313 | A | | 8/1993 | Marko et al. |
| 5,241,330 | A | | 8/1993 | Kawabata et al. |
| 5,248,997 | A | | 9/1993 | Summers |
| 5,329,283 | A | | 7/1994 | Smith |
| 5,548,321 | A | | 8/1996 | Murakami et al. |
| 5,673,212 | A | | 9/1997 | Hansen |
| 6,288,370 | B1 | | 9/2001 | Ogawa et al. |

(Continued)

FOREIGN PATENT DOCUMENTS

| | | | |
|---|---|---|---|
| EP | 1030265 | A2 | 8/2000 |
| JP | 10016290 | A * | 1/1998 |

OTHER PUBLICATIONS

Office Action mailed Mar. 15, 2012 for U.S. Appl. No. 13/035,790, filed Feb. 25, 2011.

(Continued)

*Primary Examiner* — Hai C Pham
(74) *Attorney, Agent, or Firm* — John R. Thompson; Stoel Rives LLP

(57) ABSTRACT

Laser printers are plagued with an assortment of alignment issues. In color laser printers the issues are exacerbated. Variations in distance from the mirror to the drum can lines in different color planes to vary in size. Variations in angles in the facets of the mirror can cause alignment issues between lines. Even lack of synchronization between the dot clock and start of line indication can cause misalignment between rows. In addition, a cosine distortion occurs due to the non-constant linear velocity of the laser scan of a single line. A very high speed master clock can drive the laser scanning unit. By using a very high speed clock, the control circuitry has the resolution to compensate for many of these distortion types, by appropriately counting clock cycles and indicating such to the laser modulator.

22 Claims, 24 Drawing Sheets

U.S. PATENT DOCUMENTS

| | | | | |
|---|---|---|---|---|
| 6,314,251 | B1 * | 11/2001 | Gomi et al. | 399/38 |
| 6,335,751 | B1 | 1/2002 | Morrison | |
| 6,618,462 | B1 | 9/2003 | Ross et al. | |
| 6,677,786 | B2 | 1/2004 | Kellgren et al. | |
| 7,489,328 | B2 * | 2/2009 | Akamatsu | 347/235 |

OTHER PUBLICATIONS

Notice of Allowance and Fee(s) Due for U.S. Appl. No. 13/035,790, filed Feb. 25, 2011, and mailed Aug. 30, 2012, 8 pgs.

* cited by examiner

SYSTEMS AND METHODS FOR ALIGNMENT OF LASER PRINTERS

BACKGROUND OF THE INVENTION

1. Field of the Invention

This invention relates to laser scanning devices, such as those used in laser printers, and specifically to systems and methods for aligning laser scanning devices.

2. Related Art

FIG. 1 shows a conventional monochrome laser printer 100. Laser 102 is directed through mirror 104, which is typically a polygonal mirror, but in some implementations is a prism. Photoconductive drum 106 is charged as it rotates by corona wire 108. The laser 102 discharges a small spot on drum 106. Toner hopper 110 and developer roll 112 deposit charged toner on drum 106. The toner is charged with the same charge as the drum 106, so toner only adheres to the discharged spots produced by the laser 102. As media 114, such as a sheet of paper passes through, it is charged opposite to the drum 106 so that the toner is transferred to media 114. A fuser 116 fuses the toner to the media 114.

An alternative approach is to charge the toner with a charge opposite that of the drum. In which case, the toner would be attracted to the charge on the drum rather than repelled by the charge. In which case the laser would discharge the drum where no toner should be placed.

The laser, mirror and other optical components are collectively referred to as the "laser scanning unit" or "optical unit." The laser scanning unit, along with the photoconductive drum, the fuser and other mechanical parts are collectively referred to as the "laser engine." The electronics which drive the laser engine including the laser scanning unit is often referred to as the "engine controller."

Operation of a color laser printer is similar to a monochrome printer, but the process is repeated for each color used. Conventional color laser printers use a four color printing model employing the primary colors of cyan, yellow, and magenta, along with black ("CYMK" color model). The earliest laser printers used a single laser which wrote the four colors on a single photoconductor drum in four sequential passes. This insured perfect alignment of the color planes because the same laser scanning unit is used to write each color.

A drawback with these sequential printers is that requiring the four individual passes can take up to four times the time to print a page over a single pass. Faster printing is achieved by using four laser scanning units to expose each of the four CYMK color planes in a single pass. In certain implementations these single-pass printers (also known as "inline printers") include a complete printing unit, including a photoconductor drum, corresponding to each laser scanning unit.

Inline printers have an increased complexity with the alignment of the color planes. Improperly aligned color planes—for example due to misregistration, skew or mismatched size of color planes—degrade print quality and produce artifacts similar to a badly printed copy of color newspaper comics.

With inline printers, the position of each laser scanning unit affects the color plane alignment. For example, the distance between each of the laser scanning units and the drum may vary slightly, resulting in slightly different color plane sizes, which cannot be reconciled by proper registration. The resultant effect is that somewhere on the page color aberrations will occur.

FIG. 2 illustrates two laser scanning units at slightly different distances from their drums. Laser 202 sends pulses which are directed by mirror 204 (or prism) onto drum 206.

The distance from mirror 204 to drum 206 is shown as x. The scan line produced on drum 206 has a length of y. Laser 212 sends pulses which are directed by mirror 214 onto drum 216 (or drum 206 in an alternate implementation). The distance from mirror 214 to drum 216 is shown as $x+\delta$. The resultant scan line from this laser scanning unit is shown as $y+\epsilon$. If laser 202 and 212 are modulated with the same dot clock or at the same frequency, triangles ABC and DEF are similar triangles. In this case, if $\delta$ is ¼% the length of x, the resultant error $\epsilon$ would be ¼% the length of y, which is a mismatch of 6 dots at the extremes of the scan line on a standard letter sized page of 8½ inches wide at 600 dots per inch.

Known calibration techniques can be used to measure and correct the error of the printed scan line. One technique is to mechanically adjust the distance between the laser scanning unit and the drum. This often requires manual adjustment, or motor controlled adjustments for automatic calibration, which can be very expensive. Another method inserts "fake" additional dots or removes dots in a systematic way to compensate for the difference in scan lines in an attempt to hide the aberration throughout the printed page. The difficulty in this approach is that the deletions and insertions of dots may be visible due to the uniformity of the mismatched dots on each printed scan line.

Another solution is to increase or decrease the laser writing frequency to narrow or widen the printed scan line. The laser writing frequency is commonly implemented using frequency synthesis with phase locked loops (PLLs). While PLLs are a traditional way of synthesizing frequencies, but they are relatively expensive.

Some inline color printers share components of the laser scanning unit. For example, the four laser scanning units could share a single polygonal mirror, which could eliminate the alignment problem described above in FIG. 2. However, other laser printers have two mirrors where two laser scanning units share a mirror. In this case, there would still be an alignment problem.

FIG. 3 illustrates a typical electronic implementation of a CYMK laser printing apparatus 300 using separate clock circuits using PLLs for each laser scanning unit. For each color, a laser is modulated by a control circuit which controls for each position whether a dot is written. For the purposes of nomenclature in this disclosure, each laser is associated with a color, and is referred to by that color. It does not imply that the laser actually produces that color. For example, the cyan laser described below labels the laser used to expose the cyan color plane on the photoconductive drum, not that the cyan laser generates a cyan colored beam. The control circuit is regulated by a dot clock which comprises a PLL circuit. For example, cyan laser 302 is controlled by control circuit 304 which uses dot clock 306 which contains PLL circuit 308. Yellow laser 312 is controlled by control circuit 314 which uses dot clock 316 which contains PLL circuit 322, and magenta laser 322 is controlled by control circuit 324 which uses dot clock 326 which contains PLL circuit 328. Finally, black laser 332 is controlled by control circuit 334 which uses dot clock 336 which contains PLL circuit 338. While the various control circuits can be implemented as a common control circuit, to account for the deviations in the distance from the laser scanning units to their respective drum(s) the circuitry for the various dot clocks are essentially distinct circuits and the frequencies are individually tunable.

FIG. 4 shows another alignment problem in laser printers. Error in the synchronization of the dot clock, rotating mirror and advancement of the drum from one line to another may result in the location of the first dot of each line varying based on when during a dot clock cycle a new line begins. As shown, clock signal 402 is shown with a corresponding row of dots 412. When the second row of dots is printed, the clock is askew by a ⅓ of a clock cycle as shown by clock signal 404 relative to the start of printing of the row. As a result, the corresponding row of dots 414 is indented by ⅓ of a dot. Similarly when the third row is printed, clock signal 406 is askew by a ⅓ of a clock cycle from clock signal 404 relative to the start of printing of the row. Row of dots 416 is indented by another ⅓ of a dot. In this example, clock signal 408 is further askew by another ⅓ of a clock cycle, putting it back in sync with clock signal 402. Row of dots 418 is now aligned with row 412. The dotted line shows the skew effect. When this alignment causes a subtle aberration it may be ignored. However, if each color plane operates with a dot clock at a slightly different frequency, the skew per row will may be different for each color magnifying the aberration.

The rotation of the mirror that directs the beam from a laser can cause further distortion. The mirror generally rotates at constant angular velocity. Suppose for notational sake, the mirror spins at an angular velocity of $\omega$. If a laser is on for a time interval of $\Delta t$, the mirror has an angular displacement of $\theta=\omega\Delta t$. When the beam starts out perpendicular to the page, the spot created by the laser that is on for $\Delta t$ is smaller than the spot that is created by the laser when the initial angular displacement of the beam is larger. FIG. 5A shows the spot size $\delta$ when the initial angular displacement is 0. In contrast FIG. 5B shows the spot size $\delta'$ when the initial angular displacement is $\phi>0$. Spot size $\delta'$ can be several times greater than $\delta$, which if uncheck can cause significant distortion. For example, FIG. 5C shows a plurality of dots as distorted by the constant angular velocity of the mirror. Dot 512 in the center would be the proper size while dots 514 closer to the edge of the printable region would be elongated. If the dot frequency were shorter then dots near the edge could be shortened to the proper size, but the dots near the center would be compressed.

One solution is to vary the angular velocity of the mirror to obtain a constant linear velocity across the drum. Such mechanical control of the mirror is complicated and expensive to achieve. Conventional systems use a system of optics including aspherical lenses to approximate a constant linear velocity to produce dots of consistent size, by making the optical path longer so that the amount of error is reduced to acceptable levels. In order to improve performance and reduce the size of the laser scanning unit, more complex optics are employed including the addition of mirrors, diffractive optics and light pipes. Including such optics within the correct tolerances can also be expensive. Including such optics within the correct tolerances can also be expensive.

Accordingly, it is desirable to control the width of the four color planes, the alignment of the dots between rows and the compensation for constant angular velocity of the mirror in an inline laser color printer.

SUMMARY OF INVENTION

A laser printer comprises a laser engine one or more laser scanning units and an engine controller. Described herein is a controller for driving a laser engine comprising a master clock generating a master clock signal, a laser modulator driven by the master clock signal and which signals the laser engine to produce a dot, an image control circuit which controls the laser modulator and a DDA driven by either the master clock signal or in the alternative a signal divided by a frequency divider, where the DDA signals dot boundaries to the laser modulator. The engine controller can further comprise a frequency divider which generates a slow clock signal with is a fraction of the master clock frequency. In this case, the DDA signals dot boundaries to the laser modulator by indicating after which master clock cycle a given dot boundary occurs during the current slow clock cycle. For example, the indication would be a signal meaning "dot boundary in 2 master clock cycles," "dot boundary now," or "no dot boundary this slow cycle." The DDA signals the laser modulator on the basis of the number of clock cycles in a dot period. The engine controller comprises a counter logic circuit which signals whether to turn a laser on or off and may indicate the number of master clock cycles in a given fraction of a dot. In one embodiment of the engine controller, the DDA is a pipelined first order DDA or equivalently a pipelined serial adder.

In another embodiment, a color laser printer comprises a plurality of laser scanning units each associated with a color, a master clock generating a master clock signal, and an engine controller driving the laser scanning units. Each engine controller comprises a plurality of laser modulator each driven by the master clock signal and each produces a signal to instruct the laser engine to produce a dot associated with its corresponding color, a plurality of image control circuits that control a corresponding laser modulator; and a plurality of DDAs each driven by either the master clock signal or in the alternative a signal divided by a frequency divider, where the each DDA signals dot boundaries to a corresponding laser modulator. The engine controller can further comprise a frequency divider which generates a slow clock signal with is a fraction of the master clock frequency. In this case, the DDA signals dot boundaries to the laser modulator by indicating after which master clock cycle a given dot boundary occurs during the current slow clock cycle. The engine controller a plurality of counter logic circuits each associated with a laser modulator which is signals whether to turn on or off by indicating the number of master clock cycles in a given fraction of a dot. Each DDA counts the number of master clock cycles in a dot period associated with a color. Each DDA can be a pipelined first order DDA or a pipelined serial adder. The laser scanning units can correspond to cyan, magenta, yellow and black.

Additionally, a method of indicating a dot boundary is described comprising the steps of receiving a master clock signal having a sequence of cycles, counting the cycles of the master clock signal and indicating a dot boundary when the number of cycles of the master clock signal reaches a predetermined number. This predetermined number is the number of master clock cycles in a dot period. Alternatively, the count is evaluated after a predetermined number of cycles of a master clock such as 4 or 8. The count can begin after waiting for a start of line pulse.

A high speed frequency divider is also described comprising an XOR gate, a latch driven by a master clock that latches the output of the XOR gate, and a pipelined DDA which is programmed to a given input value. The output of the DDA is connected to the input of the XOR gate, the output of the latch is connect to the input of the XOR gate. The pipelined DDA comprises a plurality of stages each comprising an adder, a latch driven by the master clock signal which latches the sum output of the adder, and a pipeline latch driven by the master clock signal, wherein the pipeline latch latches a carry output of the adder and is coupled to the adder of a subsequent stage. The divide down factor of the frequency divider is $$\frac{i}{2^s},$$

where i is the input value and s is the number of stages in the DDA. An engine controller can use this frequency divider can further comprise a master clock generating a master clock signal, a laser modulator driven by either the master clock or the output of the frequency divider and a control circuit driven by the output of the frequency divider. The output of the frequency divider is essentially equal to the desired dot clock frequency. The engine controller can comprise additional frequency dividers, laser modulators and control circuits. Each frequency divider can divide the master clock to a frequency essentially equal to a desired dot clock frequency associated with a given laser scanning unit. The desired dot clock frequency is a function of the distance from the polygonal mirror in each laser scanning unit to a drum.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

A detailed description of embodiments of the present invention is presented below. While the disclosure will be described in connection with these drawings, there is no intent to limit it to the embodiment or embodiments disclosed herein. On the contrary, the intent is to cover all alternatives, modifications and equivalents included within the spirit and scope of the disclosure.

Figure 6:
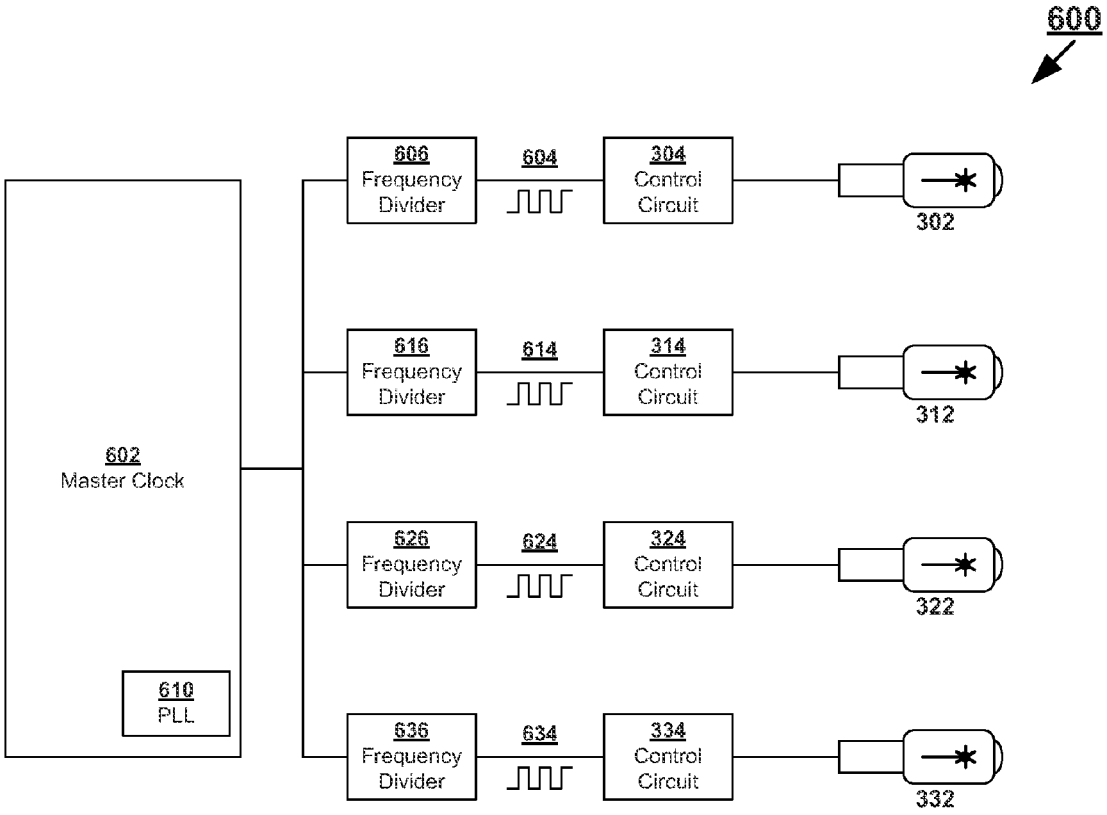
FIG. 6 illustrates an electronic implementation of a CYMK laser printing apparatus in accordance with an embodiment of the present invention.

FIG. 6 illustrates an embodiment of a CYMK laser printing apparatus 600. Laser printing apparatus 600 includes a cyan laser 302, a yellow laser 312, a magenta laser 322 and a black laser 332. Each controlled, respectively, by cyan control circuit 304, yellow control circuit 314, magenta control circuit 324 and black control circuit 334. Laser printing apparatus 600 includes a single clock circuit, master clock 602 Master clock 602 is a high frequency clock, which is frequency divided into cyan dot clock signal 604, yellow dot clock signal 614, magenta dot clock signal 624, and black dot clock signal 634, by frequency dividers 606, 616, 626 and 636 respectively.

The high frequency of master clock 602 may be selected based on practical considerations including technology and cost. For example, in current technology a typical dot clock operates at 25 MHz. If master clock 602 operates at 2.5 GHz, the frequency divider circuits would divide down by a factor of 100. If the clock 602 operates at 2.4 GHz then the frequency divider circuits would be tuned to divide down by a factor of 96. While in the preceding examples, the master clock frequency is a multiple of a desired dot clock frequency, this is not necessary. In fact, any high frequency can be used. For example, a 2.5003 GHz master clock can be used as well as a 2.5 GHz master clock. In the preferred embodiment, the actual frequency is much faster than the dot clock, and the highest frequency practical for the implementation is selected. By adjusting the frequency divider circuits, a plurality of dot clock signals can be generated at different frequencies as needed.

Figure 7:
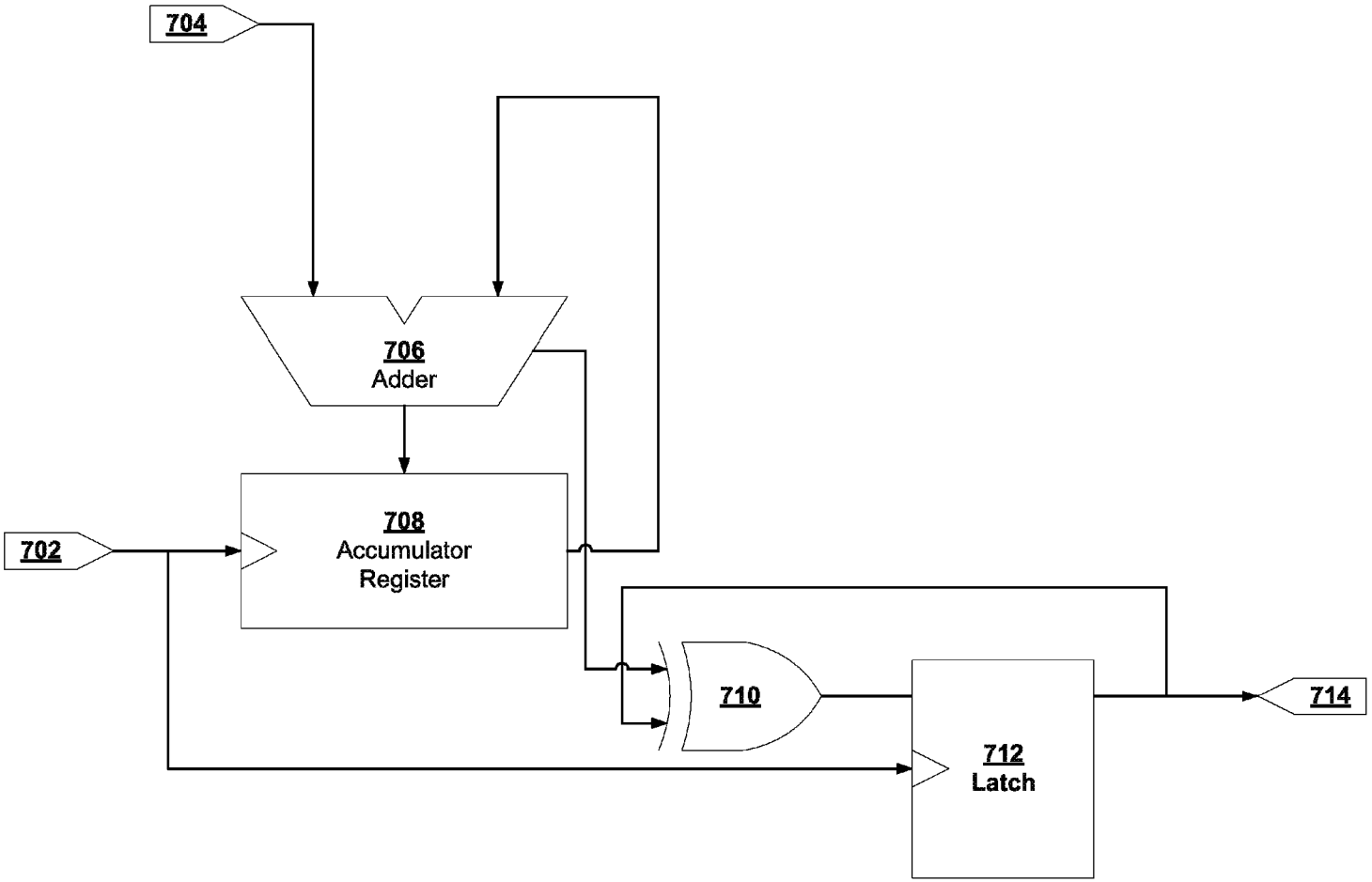
FIG. 7 (Prior Art)
FIG. 7 shows an exemplary frequency divider.
Figure 8:
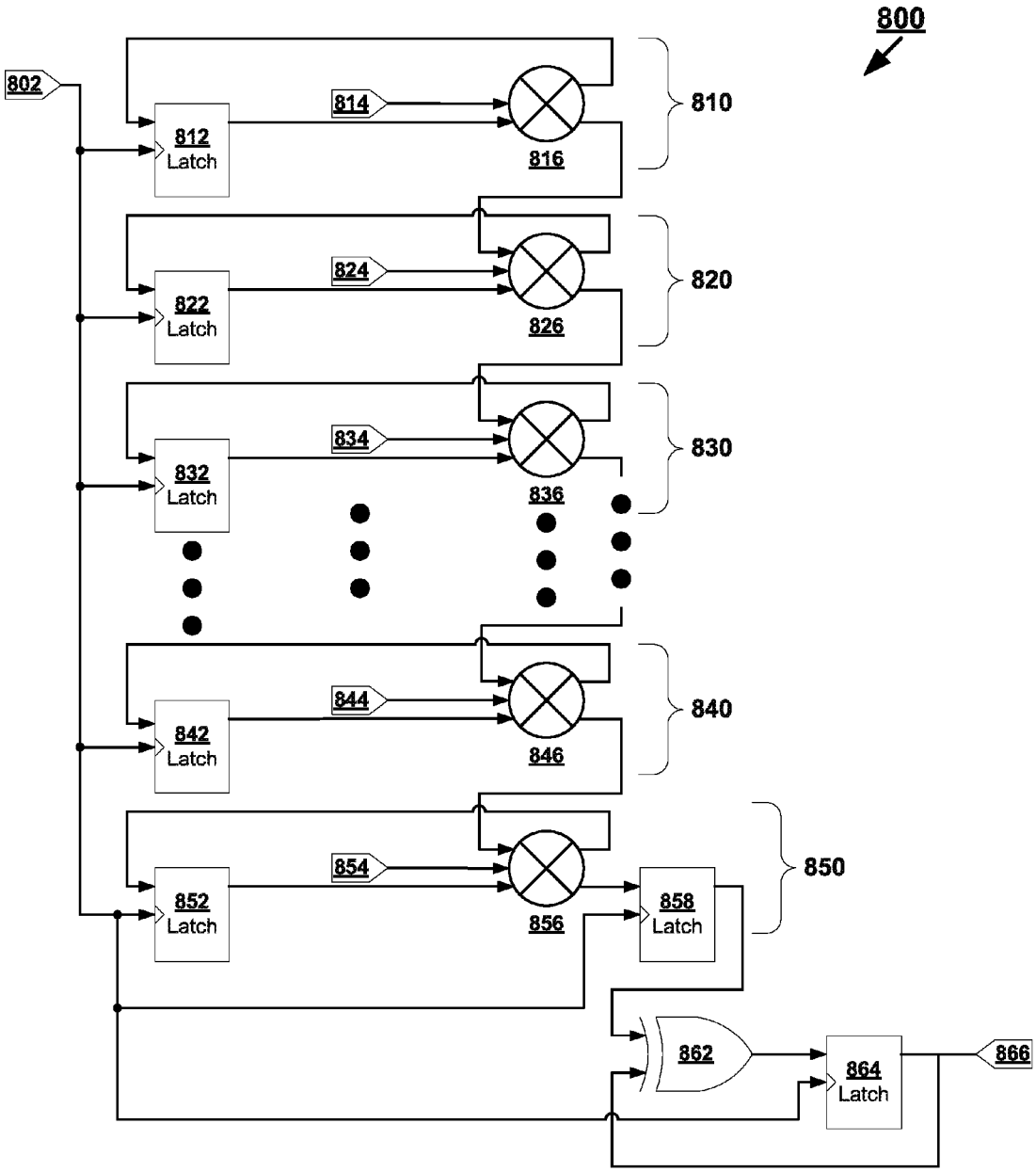
FIG. 8 (Prior Art)
FIG. 8 illustrates an implementation of the frequency divider circuit as a first order DDA.

While frequency dividers are usually fairly simple in design, they are not so straightforward in high speed applications. FIG. 7 and FIG. 8 show exemplary frequency dividers constructed from traditional designs. These traditional frequency dividers suffer from the fact that the constituent adder or adding circuitry limits the speed of operation.

FIG. 7 shows an exemplary frequency divider that includes an adder 706, an accumulator 708, an XOR gate 710 and a latch 712. Master clock signal 702 operates accumulator 708 and latch 712. In some embodiments, the master clock signal 702 may also be used to drive adder 706. A divide by parameter is supplied to adder 706 through signal 704. Accumulator 708 feeds the sum back to adder 706, and the overflow bit of the adder is sent to XOR gate 710 which forces the latch 712 to change states. For example, if adder 706 is a 5-bit adder and the divide by parameter is 3, then adder 706 overflows when the sum is greater than 31. The output of adder 706 in this configuration assuming accumulator 708 is zeroed at the start is 3, 6, 9, 12, 15, 22, 21, 24, 27, 30, 1+ overflow. The last number in the sequence given should be 33 but the adder has overflowed, so the result is 1, but the overflow bit set. Therefore, this causes output clock signal 714 to change states after 11 cycles. Continuing the example, the clock then changes states after another 11 cycles. Effectively, the frequency of the master clock has been divided by 22, i.e., 11 cycles for a falling edge and 11 cycles for a leading edge. It should be noted that one out of three times however, the clock state changes after only 10 cycles so the resultant clock has an approximate frequency of 1/22 of the frequency of the master clock.

FIG. 8 illustrates a traditional implementation of a frequency divider circuit 800 as a first order digital difference analyzer (DDA). In this example, 5 stages of the DDA are shown, specifically stages 810, 820, 830, 840, and 850. Each stage comprises a latch (e.g. latches 812, 822, 832, 842, and 852), and an adding component (e.g., adding component 816, 826, 836, 846, and 856); each stage also receives a corresponding bit of a divide by parameter (e.g., bits 814, 824, 834, 844, and 854). Examining stage 820 in more detail, it comprises latch 822 and adding component 826. Latch 822 holds the value of the input for a clock cycle and can be a flip-flop such as a D-flip-flop. Adding component 826 adds a corresponding bit from divide by parameter 824, in this case the second lowest bit, the carry bit from previous stage 810 and the bit from the previous iteration of the addition. Adding component 826 generates a sum output which is fed back to latch 822 and a carry output which is fed to next stage 830. The other stages are essentially identical except since stage 810 is the first stage, it receives no carry bit from a previous stage, and since stage 850 is the last stage, the carry bit is the overflow of the adder and is latched by latch 858 to be used by XOR gate 862 which operates similarly to XOR gate 710 described above. Latch 864 is used to control clock signal 866 in the similar way as described for latch 712.

In this implementation, one period of the master clock is limited by the time it takes the carry output to propagate from the first stage to the final overflow output. When the DDA is operating properly, sufficient time passes for the carry output of last stage 850 and specifically adding component 856 to be generated. Before the carry output of adding component 856 can be generated, the carry output adding component 846 is generated which in turn uses the carry output generated by adding component 836 and so forth. The more resolution/stages in DDA, the longer clock period. Although other logic designs exist for adder circuitry which reduce the time for the carry to propagate to the final overflow output, the time required remains an important constraint on the maximum clock speed.

Figure 9:
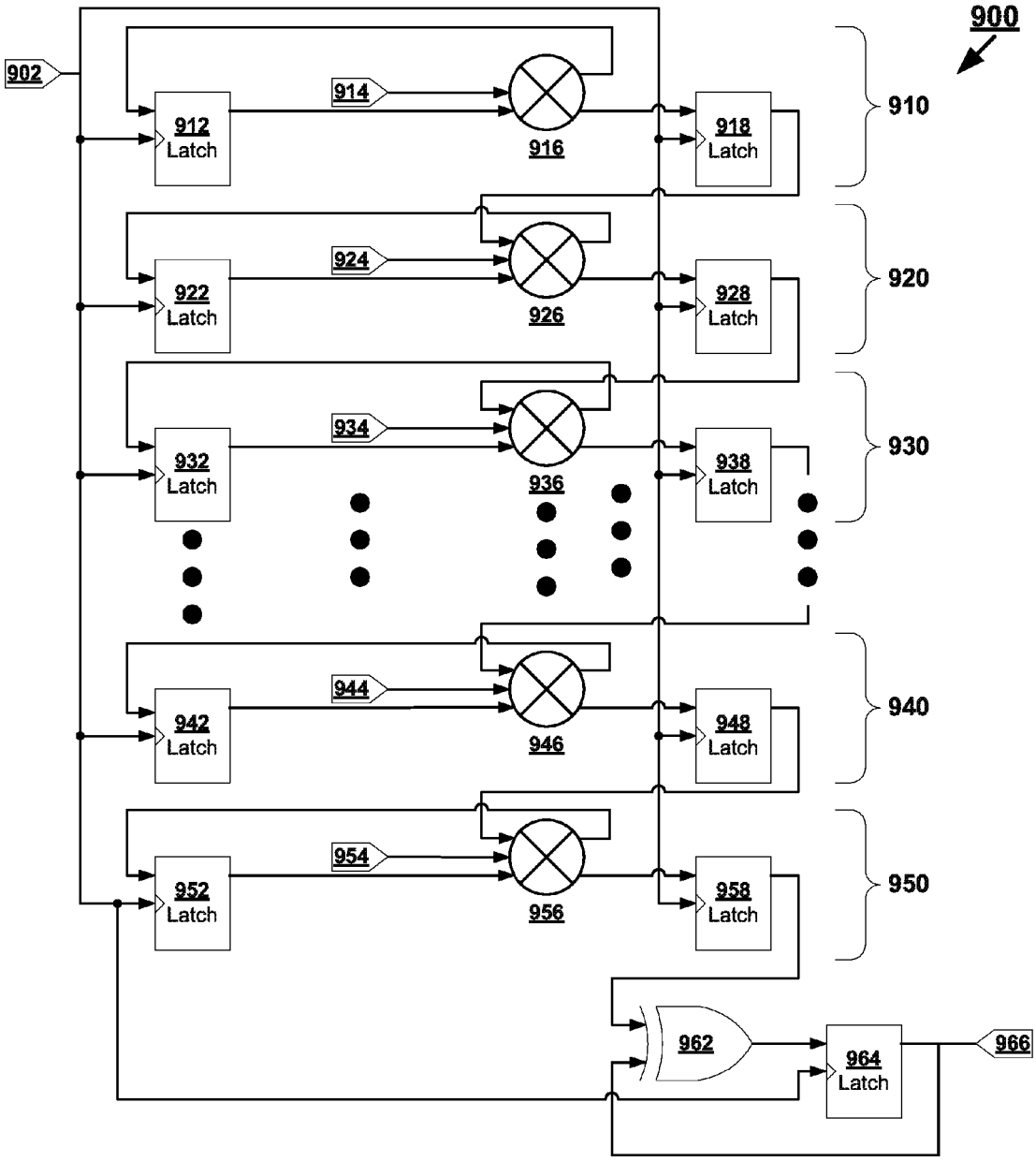
FIG. 9 illustrates an implementation of the frequency divider circuit as a first order pipelined DDA.

FIG. 9 illustrates an embodiment of a frequency divider circuit 900 implemented as a first order pipelined digital difference analyzer. In this example, 5 stages are shown for an n-bit DDA—stages 910, 920, 930, 940 and 950, respectively. Each stage comprises a latch (e.g. latches 912, 922, 932, 942, and 952) for latching a sum bit, an adding component (e.g., adding component 916, 926, 936, 946, and 956), and a pipelining latch (e.g., latches 918, 928, 938, 948, and 958); each stage also receives a corresponding bit of a divide by parameter (e.g., bits 914, 924, 934, 944, and 954). Stage 920 includes a latch 922 and adding component 926. Latch 922 holds the value of the input for a clock cycle, and adding component 926 adds a corresponding bit from the divide by parameter 924, the carry bit from the previous stage 910 and the bit from the previous iteration of the addition.

At each stage, the carry bit is stored in a pipelining latch, such as the pipelining latch 928 in stage 920. As a result, a pipelined sequence of sums is seen after each clock cycle of clock signal 902. In the illustrated embodiment, latch 958 stores a pipeline sequence of overflow bits that operate XOR gate 962. Unlike the DDA of FIG. 8, there is a latency of n cycles before a given sum is available. The output of latch 958 is not representative of the sequence of sums desired until after n cycles when the data has had a chance to propagate through the pipeline. After an initial startup, the system 900 operates as a frequency divider. Because the carry bit is latched at each stage, the clock period can be as short as the time it takes a carry output to propagate through a single stage. Therefore, the clock speed could potentially be n times faster than that of the DDA in FIG. 8.

Figure 1:
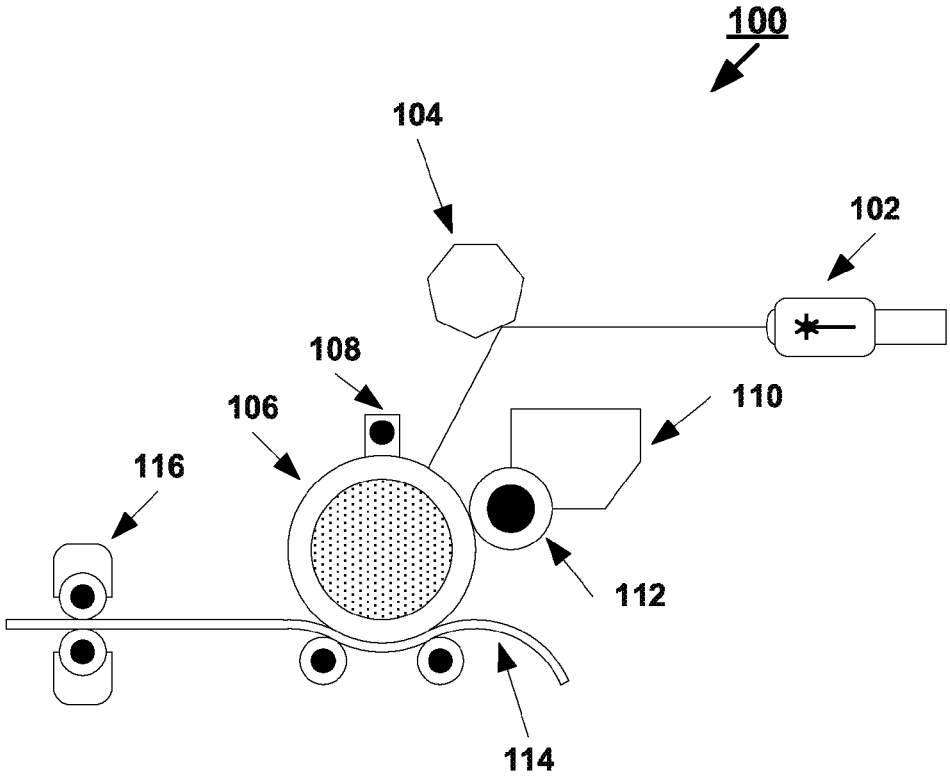
FIG. 1 (Prior Art)
FIG. 1 shows a conventional monochrome laser printer.
Figure 2:
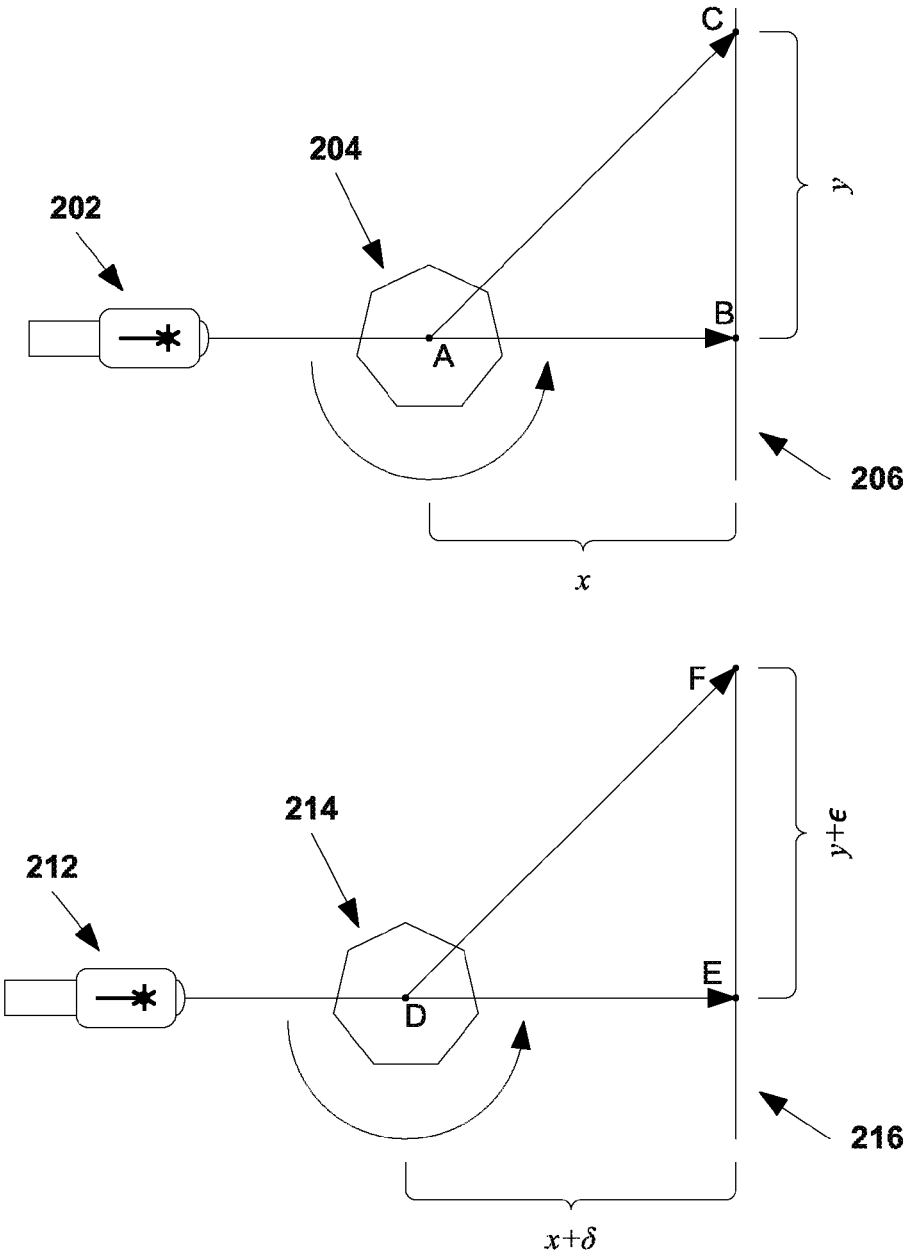
FIG. 2 (Prior Art)
FIG. 2 illustrates two laser scanning units positioned at different distances from corresponding drums.
Figure 3:
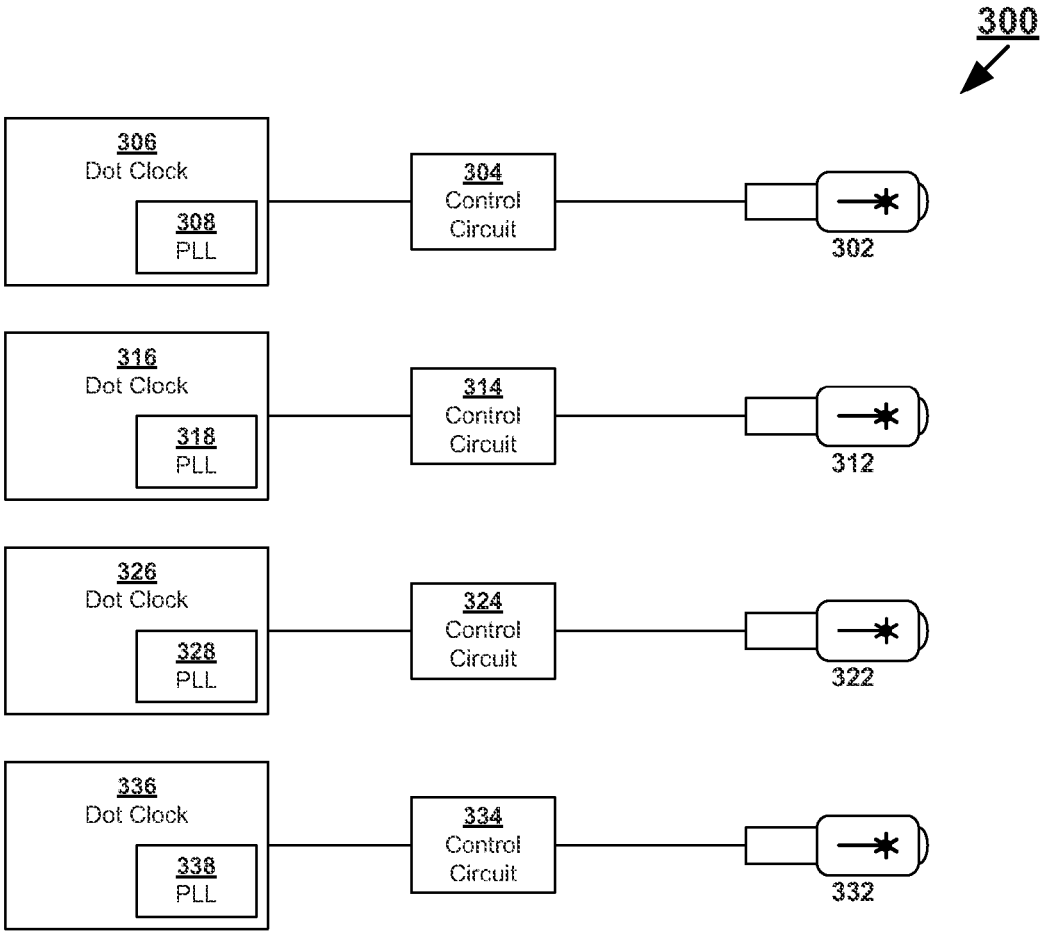
FIG. 3 (Prior Art)
FIG. 3 illustrates a conventional electronic implementation of a CYMK laser printing apparatus.
Figure 4:
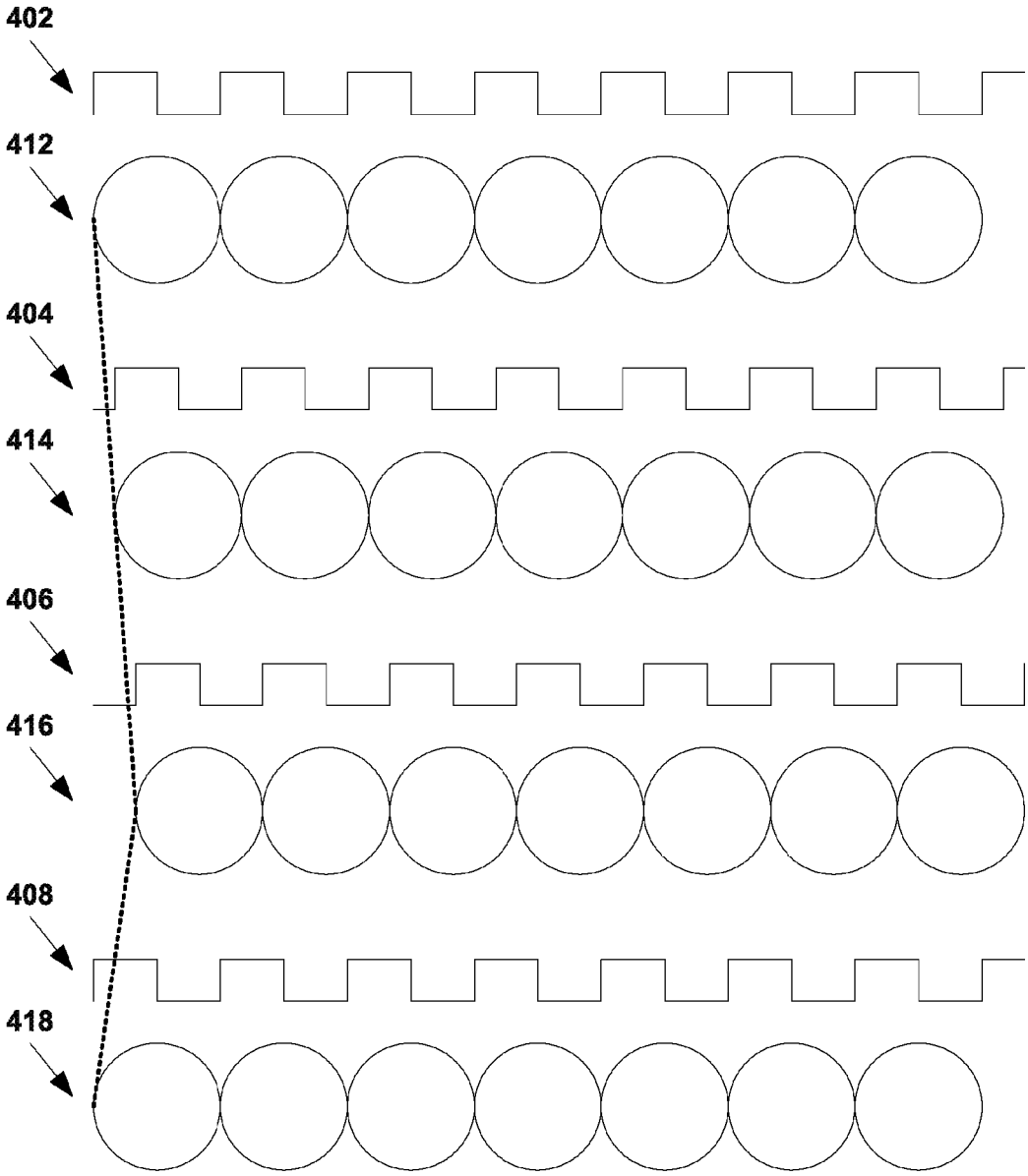
FIG. 4 (Prior Art)
FIG. 4 shows an alignment problem in laser printers.
Figure 10:
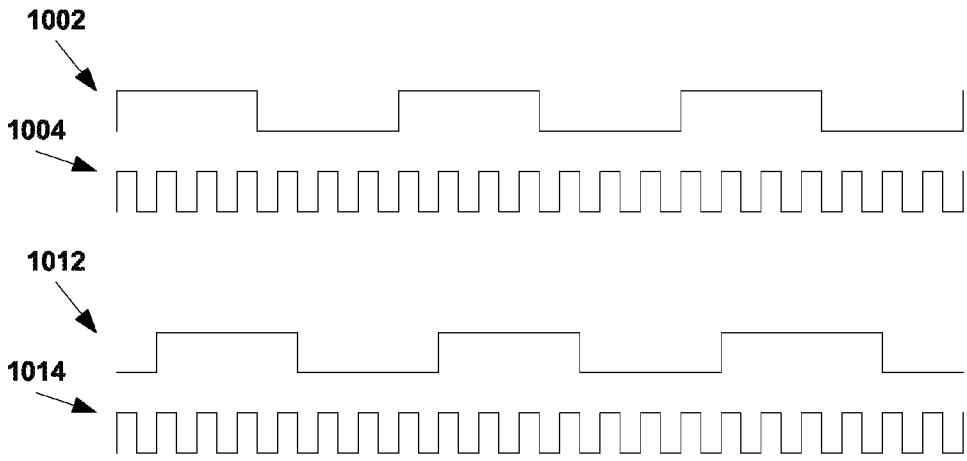
FIG. 10 illustrates an embodiment of a master clock signal for one row of dots which generates a dot clock signal.

The use of a dot clock, even using a master clock, can still possibly result in a skewing of dots between rows as explain with reference to the alignment problem illustrated in FIG. 4. FIG. 10 illustrates an example of master clock signal 1004 for one row of dots which generates dot clock signal 1002. In the subsequent row, master clock signal 1014 generates dot clock signal 1012 and depending on when the second row starts there may be a skew between dot clock signal 1002 in the first row and dot clock signal 1004 relative to the start of the printing of second row 1014.

Typically in a laser printer the control circuit receives a start of line pulse. There are many ways to determine the start of line, but most methods are triggered off a either the position of a mirror facet either determined mechanically or optically with a photodetector. Basically, when a mirror reaches the start of line position, determined by any of the known methods mentioned a start of line pulse is generated.

Figure 11:
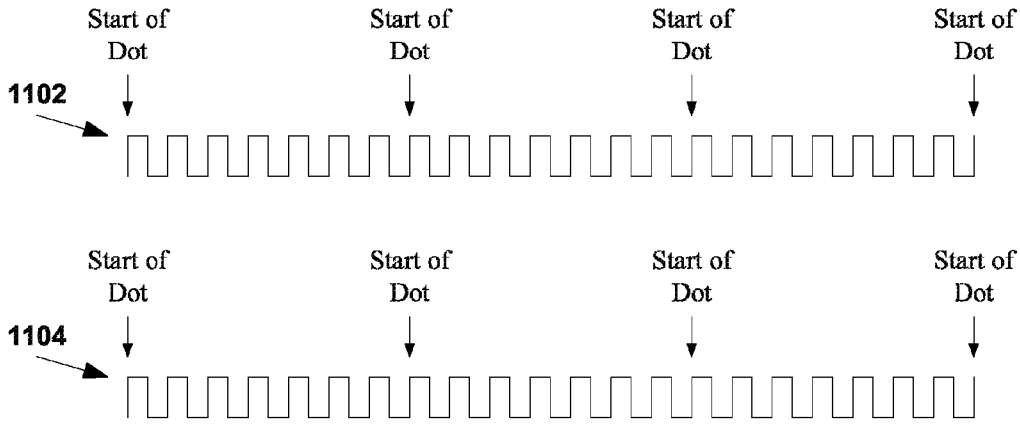
FIG. 11 illustrates an embodiment of dot timing relative to a master clock.

An embodiment for reducing skew between rows will now be described with reference to FIG. 11. In this embodiment, the logic for determining the start of a dot is based on the master clock (as opposed to a dot clock), allowing the start of the first dot on the row to be synchronized to the master clock which is operating many times faster than a dot clock. FIG. 11 illustrates the dot timing relative to a master clock. Clock signal 1102 shows the master clock during the printing of the first row. A control circuit periodically determines when the start of the dot occurs. For example, it may be determined that the next dot begins at the $52^{nd}$ master clock cycle (shown in the example as 7 master clock cycles, but in actual operation the master clock should be faster) from the start of the row. Similarly, clock signal 1104 shows the master clock during the printing of the second row. The control circuit determines the start of each dot to better synchronize the timing to the start of the printing of each row. There can be skew between the master clock signal that starts the printing of each row. In this embodiment, however, the skew is limited to up to one master clock cycle which may be 1/50 or 1/100 the size of a dot, thereby reducing the skew to a negligible factor.

Figure 12:
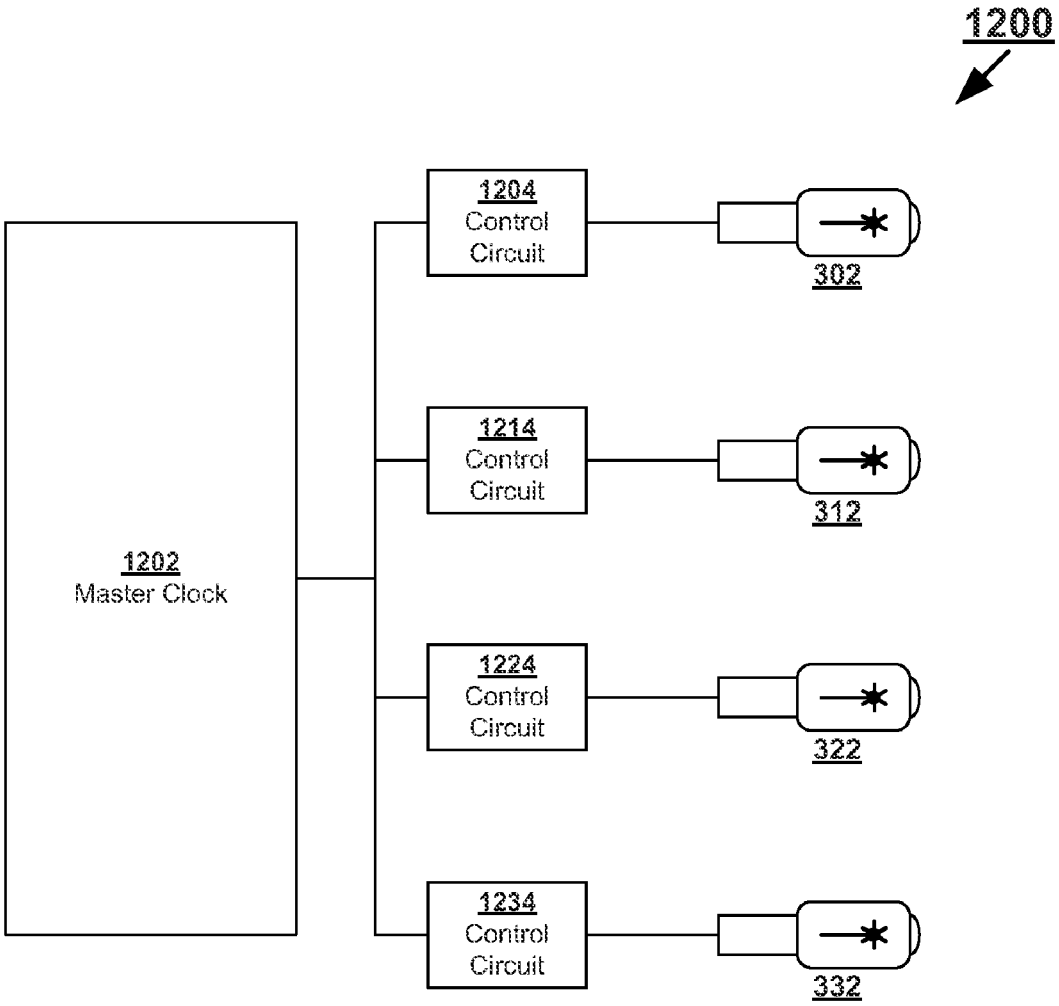
FIG. 12 illustrates an electronic implementation of a CYMK laser printing apparatus in accordance with an embodiment of the present invention.

FIG. 12 illustrates an embodiment of a CYMK laser printing apparatus without the use of dot clocks or a factional clock divider. In system 1200, each control circuit accepts the master clock signal generated by master clock 1202 directly, as shown by control circuits 1204, 1214, 1224, and 1234.

Figure 13:
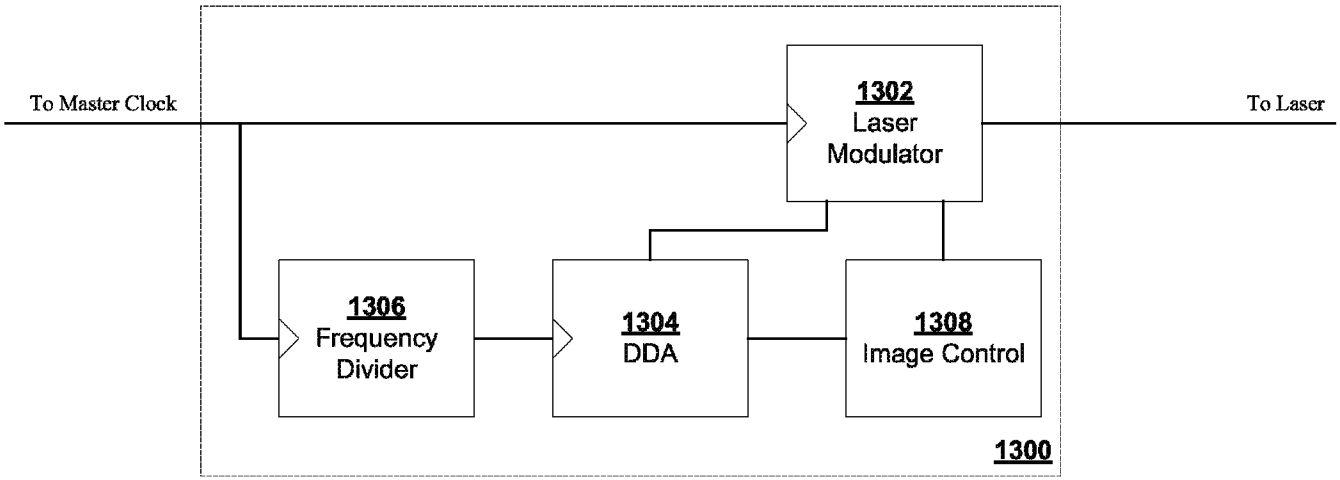
FIG. 13 shows an embodiment of a control circuit.

FIG. 13 shows an embodiment of a control circuit 1300 that may be used as control circuit 1204, 1214, 1224, and/or 1234.

The master clock signal is divided by frequency divider 1306 which may be implemented at high speed, because the divide down factor may be smaller than used in the frequency divider in system 600 (see FIG. 6), such as 4 or 8. DDA 1304 is used to determine when a dot starts and is clocked off the slower clock output from the frequency divider 1306. The divide down factor of frequency divider 1306 is selected to be high enough to allow DDA 1304 to be implemented easily but low enough so that frequency divider 1306 can be implemented easily.

DDA 1304 in conjunction with image control module 1308 controls laser modulator 1302 which switches the laser on and off. In this embodiment, the DDA is not used to directly indicate to laser modulator 1302 exactly when the start of a dot begins, but instead returns a state indicative of when a new dot occurs. Image control module 1308 indicates at a given position whether a dot should be written. The DDA 1304 indicates to laser modulator 1302 where the dot boundaries are and image control module 1308 indicates to laser modulator 1302 whether a dot should be written. Additionally, control circuit 1300 receives a start of line pulse which it can pass on to DDA 1304 to synchronize the first dot boundary.

Control circuit 1300 is depicted comprising the frequency divider 1306. In an alternate embodiment, control circuits 1204, 1214, 1216, and 1218 (see FIG. 12) could share a frequency divider because the ratio of the frequency divider used by the different control circuits can be the same.

Figure 14:
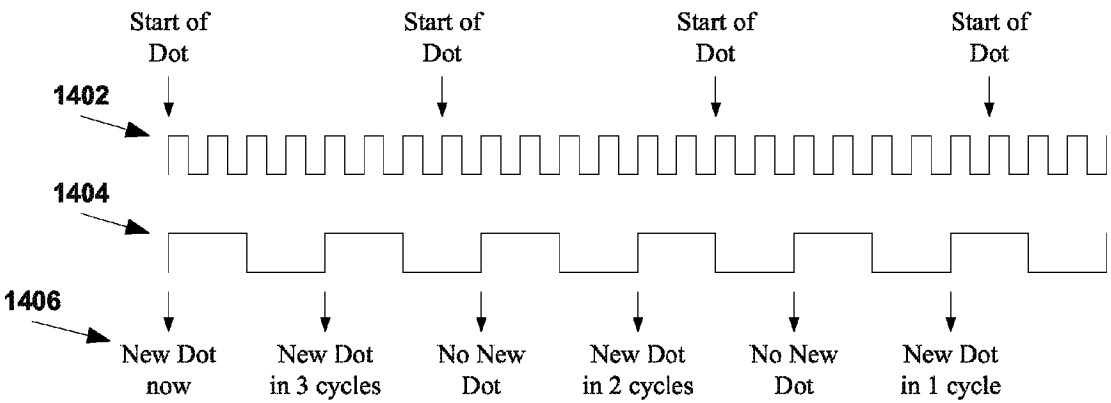
FIG. 14 shows a timing diagram of an embodiment of a DDA signaling the laser modulator.

FIG. 14 shows an example of the timing behind how a DDA 1304 can signal the laser modulator 1302 of FIG. 13. For purpose of illustration, a new dot starts every 7 master clock cycles though in practice it would be desirable to use a much faster master clock. The master clock signal is shown as clock signal 1402. Clock signal 1404 is master clock signal 1402 divided by 4 to ¼ the master clock frequency. Output 1406 is indicative of the output of the DDA. Initially, the DDA indicates the start of a new dot. At the next clock cycle, the DDA determines that a new dot will begin after 3 master clock cycles so the laser modulator can turn on or off according to whether a dot needs to be printed. At the third clock cycle, no new dot will begin in the next four master cycles so that is indicated to the laser modulator. At the fourth clock cycle the DDA determines a new dot will begin after 2 master clock cycles, and so forth as shown in FIG. 14. In this way, laser modulator 1302 can operate accurately on a dot boundary without the need for high speed complex logic.

Figure 15:
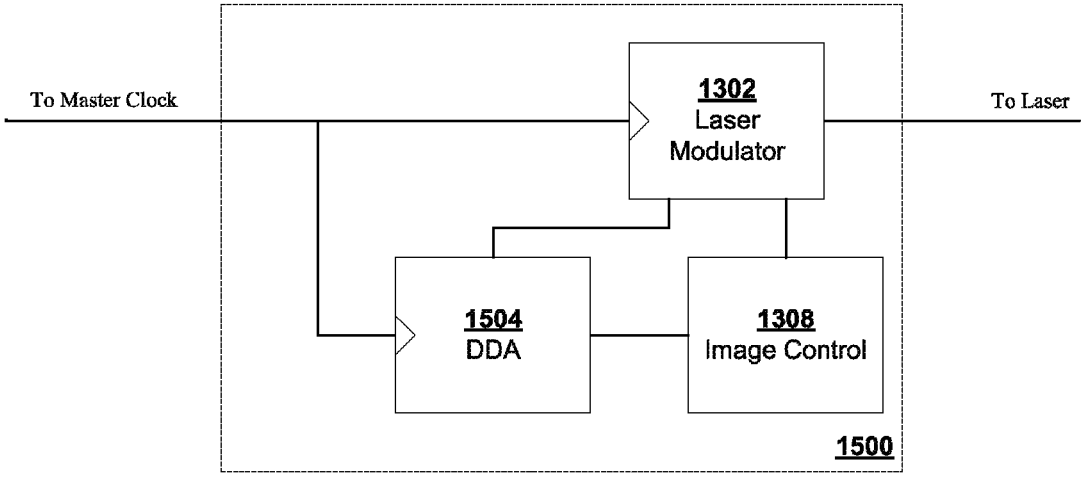
FIG. 15 illustrates an implementation of a control circuit using a high-speed pipelined DDA.

FIG. 15 illustrates an alternate embodiment of a control circuit using a high-speed pipelined DDA. A control circuit 1500 includes a laser modulator 1302, image control module 1308 and a high-speed pipelined DDA 1504. Unlike control circuit 1300 of FIG. 13, control circuit 1500 does not include a frequency divider. Because an initial zero state does not guarantee the correct first dot boundary, an initial state that results in the correct positioning of the first dot boundary is precalculated, and when the start of line pulse is received all sum bit latches of the DDA 1504 are set to this initial state.

Figure 16:
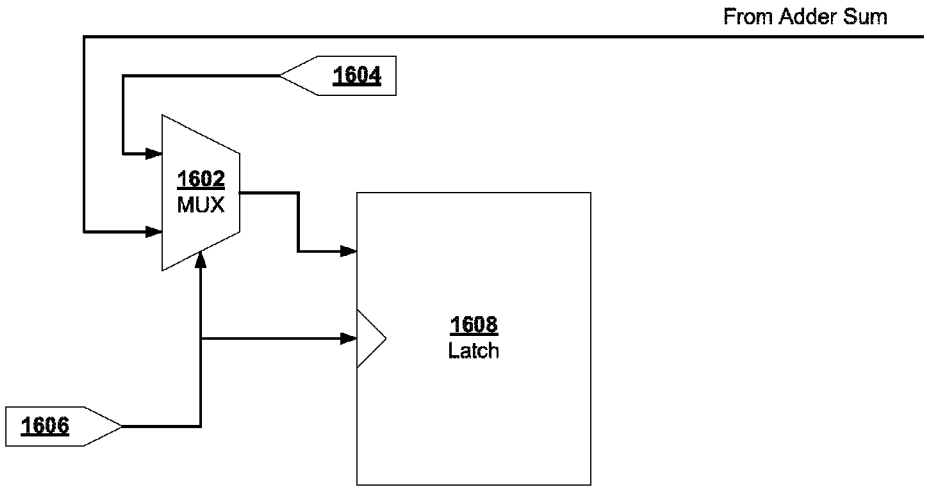
FIG. 16 shows an embodiment of a stage of the high-speed pipelined DDA that enables the initialization of states.

FIG. 16 shows an embodiment of a stage of the high-speed pipelined DDA that enables the initialization of states. Latch 1608 is representative of any of the sum bit latches (e.g. latch 912, 922, 932, 942, or 952) in DDA 900. In addition to latch 1608, the stage further comprises a 1-bit multiplexer 1602. When the start of line pulse is received (or any other condition requiring the load of initial state), multiplexer 1602 loads initial state bit 1604 into latch 1608. In this way, the DDA can be aligned to the true start of line. At all other times, multiplexer 1602 loads the sum bit received from the adding component in that stage. In this embodiment, the carry bit latches (e.g. latch 918, 928, 938, 948 or 958 of FIG. 9) are reset to zero when the DDA is set to the initial state.

Either control circuit 1300 or 1500 can be used to adjust for start of line synchronization problems. The start of line pulse may be generated for each mirror used. However, in many laser printer implementations, the start of line pulse is generated by the position of a single mirror. While each polygonal mirror is generally synchronized, due to the differences in the facets of each mirror, the start of line associated with one mirror is not precisely the same position as the start of line associated with another mirror. For example, if the start of line pulse is trigger by the "black mirror" that is a 4-facet mirror having precise perpendicular facets, but the cyan mirror which is also a 4-facet mirror has facets that are slightly off perpendicular, then the start of line pulse would not always indicate true start of line for the cyan color plane. This results in colors that are misaligned. These imperfections can be compensated for by assigning for each color plane a different start location relative to the start of line pulse. For example, to compensate for this mirror facet aberration, the true start of line may begin $\tau$ ns after the start of line pulse which may translate into s master clock cycles.

Figure 17:
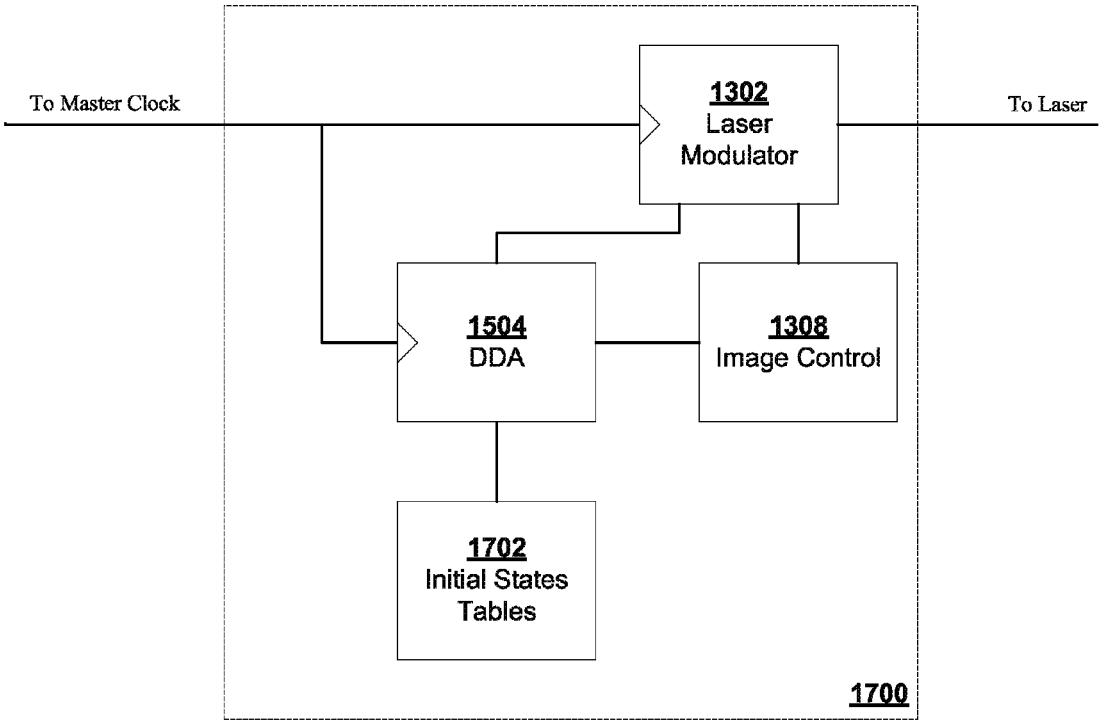
FIG. 17 illustrates an embodiment of a control circuit with mirror compensation facet.

FIG. 17 illustrates an embodiment of a control circuit with a mirror facet compensation. Upon the receipt of the start of line pulse, control circuit 1700 determines which facet of the mirror is responsible for scanning the current line. Because each facet on a mirror is responsible for scanning one line of text, a simple count can keep track of which facet is scanning the current line Based on this information, control circuit 1700 loads an initial state for DDA 1504 from initial states table 1702, to enable DDA 1504 to start with the appropriate offset for accurate alignment of dots to the true start of line. A similar modification could be made to control circuit 1300 to achieve the same mirror facet compensation It should be noted that any control circuit associated with the mirror from which the start of line pulse is generated need not require any facet compensation or if a start of line pulse is generated based on each mirror facet compensation would not be needed.

Figure 18:
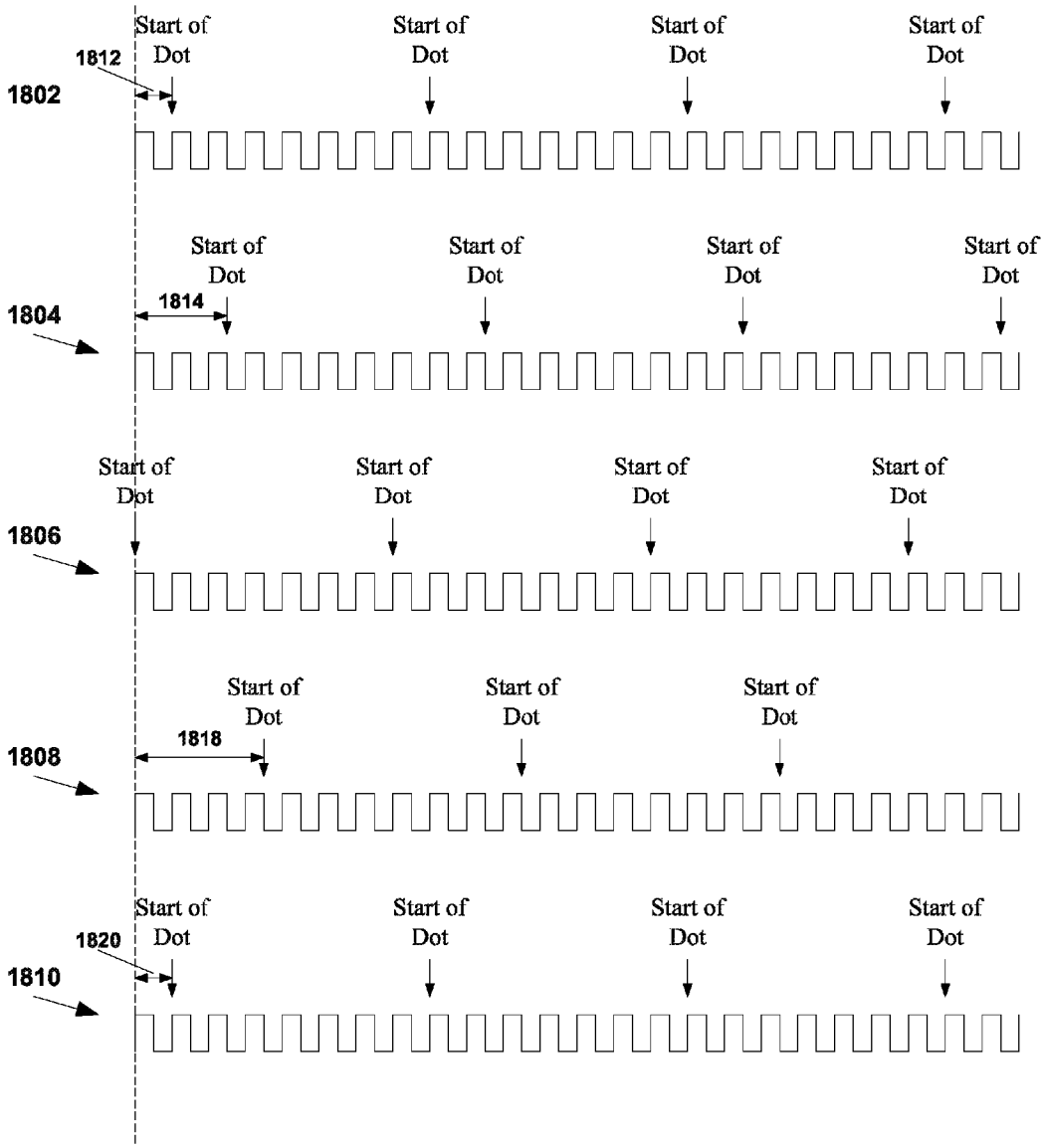
FIG. 18 shows an embodiment of the timing of mirror facet compensation for a four facet mirror.

FIG. 18 shows an exemplary timing of mirror facet compensation for a four facet mirror. Line 1802 shows the master clock signal for the first line. The DDA periodically generates start of line indications, but because it is known a first mirror facet is responsible for the first line, the first start of dot indication is delayed by offset 1812. Likewise, as shown in second line 1804 the first start of dot indication is delayed by offset 1814 to compensate for an aberration in a second mirror facet that is responsible for the second line. This continues for the third line 1806 and fourth line 1808. The first facet is responsible for generating the fifth line 1810, so offset 1820 is the same offset as offset 1812.

Figure 19:
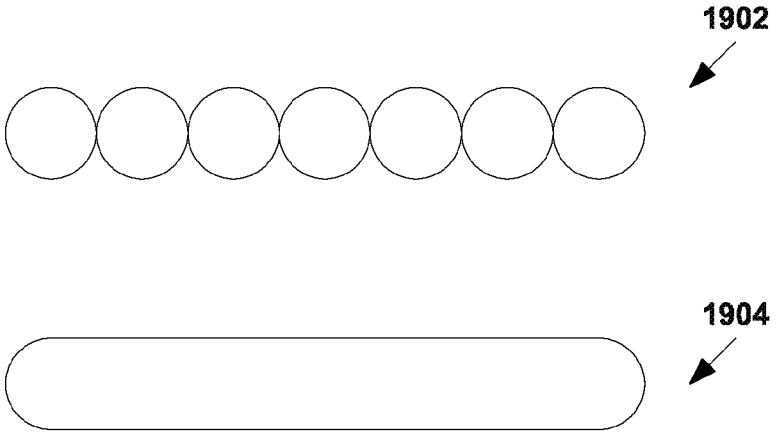
FIG. 19 shows a sequences of dots written by a laser printer.

FIG. 19 shows an embodiment of how certain laser printers produce a sequence of dot. A sequence of 7 dots may be separately printed as shown by line 1902, or alternatively, the laser is turned on to write the first dot and is turned off after the seventh dot resulting in pattern 1904. Based on the indication given by image control module 1308, the laser modulator 1302 in FIG. 13 would turn on at a dot boundary and turn off at another boundary, but not necessarily at consecutive boundaries forming separate dots.

The use of a high speed clock coupled with a DDA to indicate dot boundaries can allow for more precise alignment of dots between rows. The position of dots may be purposefully skewed to produce crisper looking images without an actual increase in resolution of the printer. In addition, it would be possible to create dots of varying widths beyond integer multiples of a dot width, such as 1½ or 1¼ dots, for example.

Figure 20:
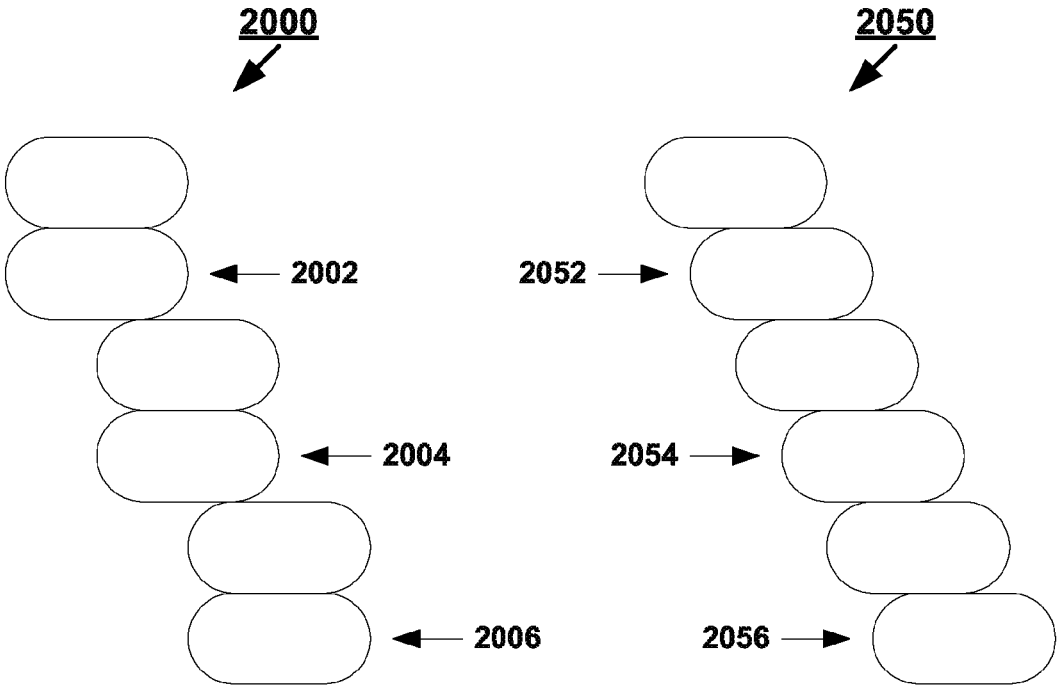
FIG. 20 illustrates magnified views of a diagonal line produced by a laser printer.
Figure 21:
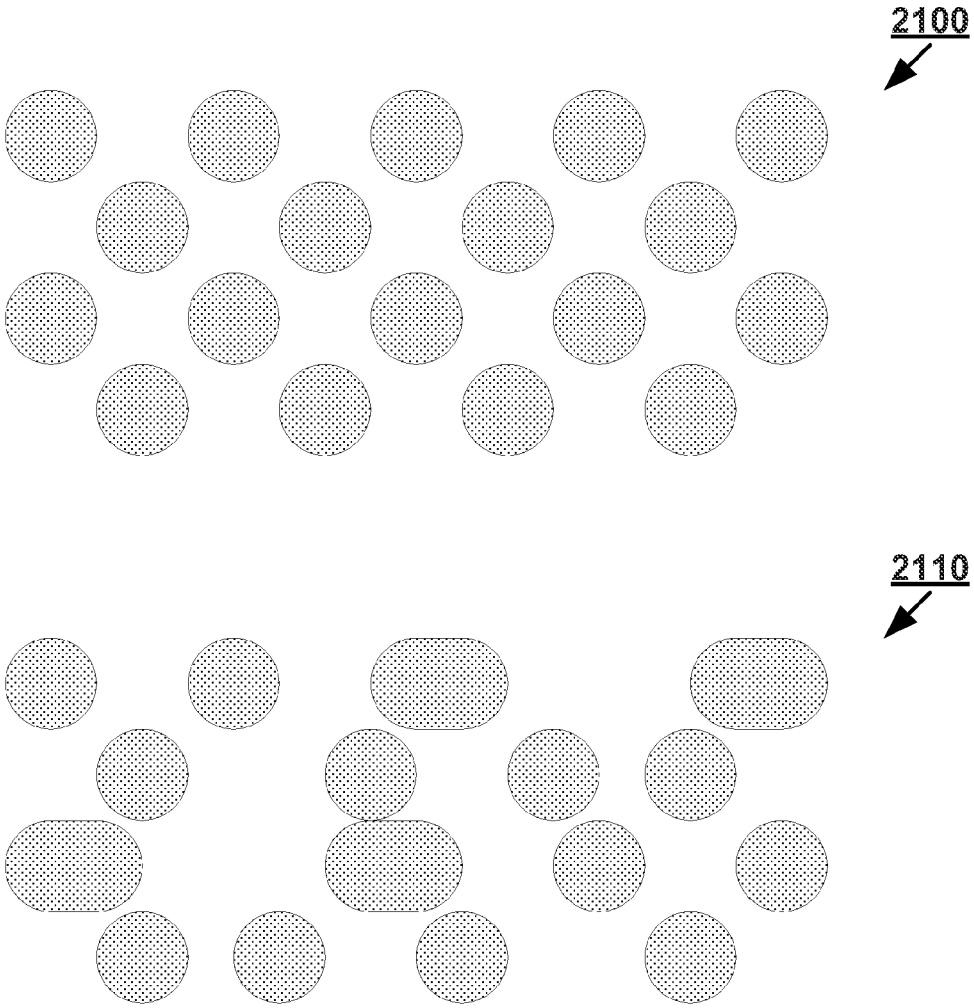
FIG. 21 shows examples of a magnified view of a 50% grey region.

The use of a high speed clock enables a richer set of possibilities when it comes to printing, by allowing the alteration of the size and alignments of a "dot" or dot spans. Two examples are shown in FIGS. 20 and 21. FIG. 20 illustrates magnified views of diagonal lines. Diagonal line 2000 uses dots aligned to dot boundaries. Diagonal line 2050 has dots aligned to ½ dot boundaries. In particular, two dot spans 2052, 2054, and 2056 are shifted ½ a dot in comparison to their counter parts 2002, 2004, and 2006. Diagonal line 2050 smoothes out the some of the jaggedness compared to diagonal line 2000.

Using known image processing techniques and the techniques described herein, diversity can be added to a shaded region. FIG. 21 shows examples of a magnified view of 50% grey region. Region 2100 exemplifies a typical grey region where dots give an effect of grey by alternating black dots with no dots (or "white dots"). However, such a regular pattern of dots can produce undesirable effects such as Moire patterns. With the ability to vary the size of and alignment of dots a more irregular pattern can be used while maintaining a 50% overall grey effect, such as shown in region 2110.

Figure 22:
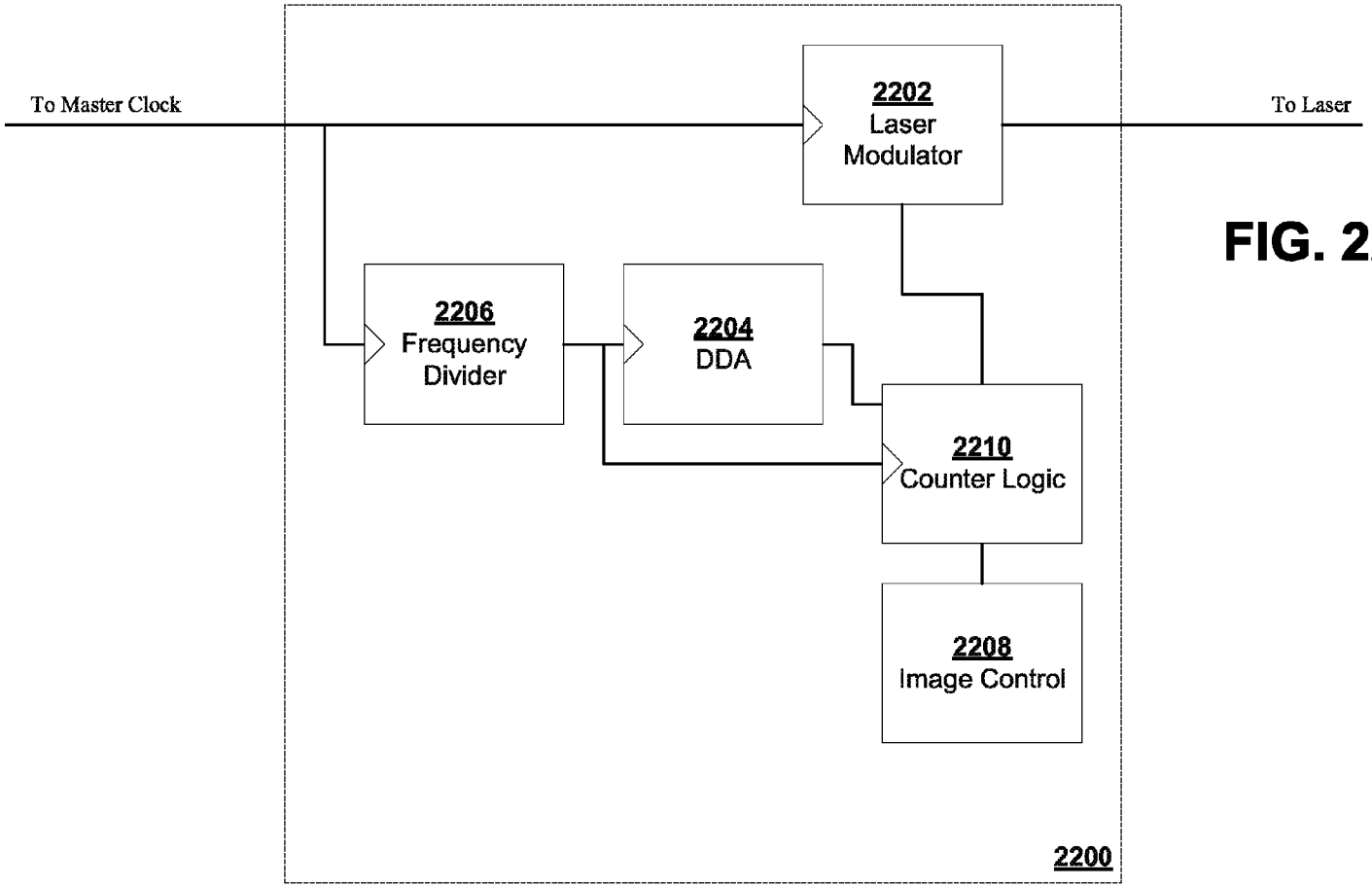
FIG. 22 illustrates an embodiment of a control circuit.

FIG. 22 illustrates an embodiment of a control circuit capable of varying the alignment to fractional dot boundaries as well as the width of dot spans to incorporate partial dots. Circuit 2200 comprises laser modulator 2202, frequency divider 2206, and DDA 2204. Frequency divider 2206 is has a divide down factor selected along the same criteria as that of frequency divider 1306. The DDA 2204, like DDA 1304, keeps track of the dot boundaries. Control circuit 2200 further comprises counter logic circuit 2210 which is controlled by image control module 2208. Image control module 2208 signals to counter logic circuit 2210 the location of dot spans in terms of partial dots. Counter logic circuit 2210 also uses dot boundary information signaled by DDA 2204 to, signal to laser modulator 2202 when to turn the laser on or off. Counter logic circuit 2210 in this embodiment is driven by the slower clock signal of frequency divider 2206.

Figure 23:
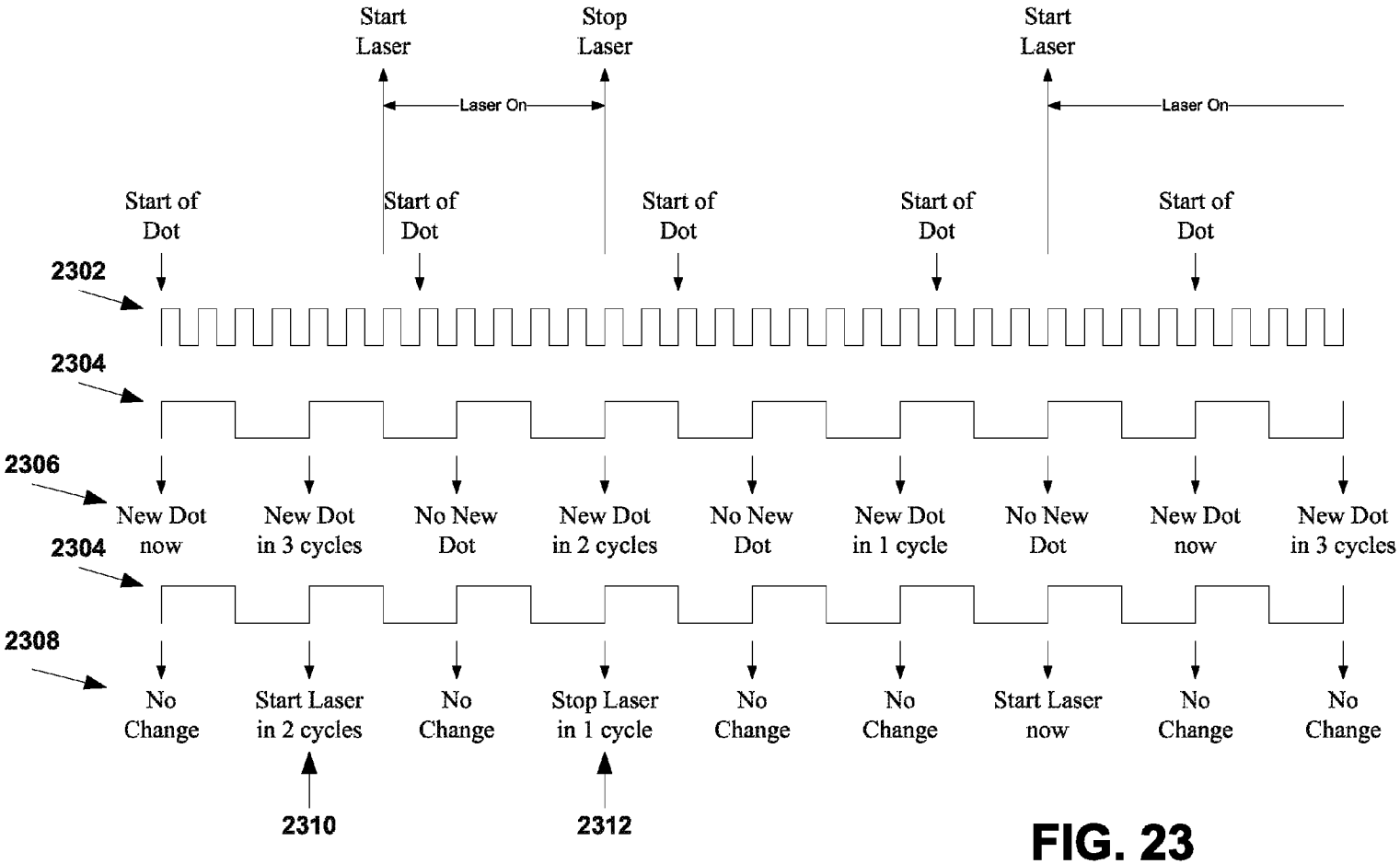
FIG. 23 illustrates an example of the timing and outputs of a DDA.

FIG. 23 illustrates an example of the timing and outputs of the DDAs used in FIG. 22. Clock signal 2302 is the master clock signal. Clock signal 2304 is the clock signal supplied to the DDAs 2204 and counter logic circuit 2210 by frequency divider 2206. Outputs 2306 are the output of the dot boundary tracking DDA 2204. The counter logic circuit 2210 produces output 2308. The counter logic circuit 2210 is clocked at a fraction of the master clock rate and cannot give an instantaneous indication of the starting or stopping of the laser, but it can provide an indication of when in the next fractional clock cycle to start or stop the laser. In this example, the counter logic circuit indicates first to start the laser in two clock cycles after the output is received at 2310. It indicates then to stop the laser in one clock cycle after output is received at 2312. In one embodiment, counter logic circuit 2210 is a DDA or a simple counter which is set at each dot boundary.

In an alternate embodiment, the functionality of the DDA and counter logic circuit are combined into one DDA. Selection of a single DDA or a DDA and counter logic circuit may depend on design constraints.

Figure 5A:
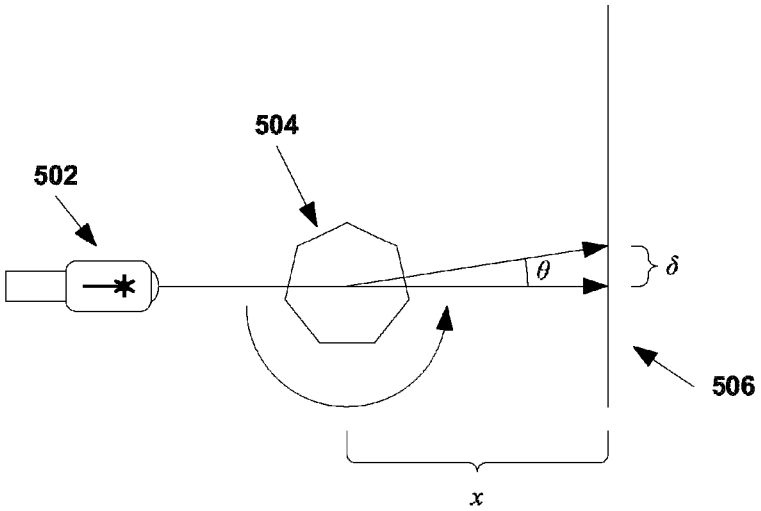
FIG. 5A (Prior Art)
FIG. 5A shows the spot size when the initial angular displacement is 0.
Figure 5B:
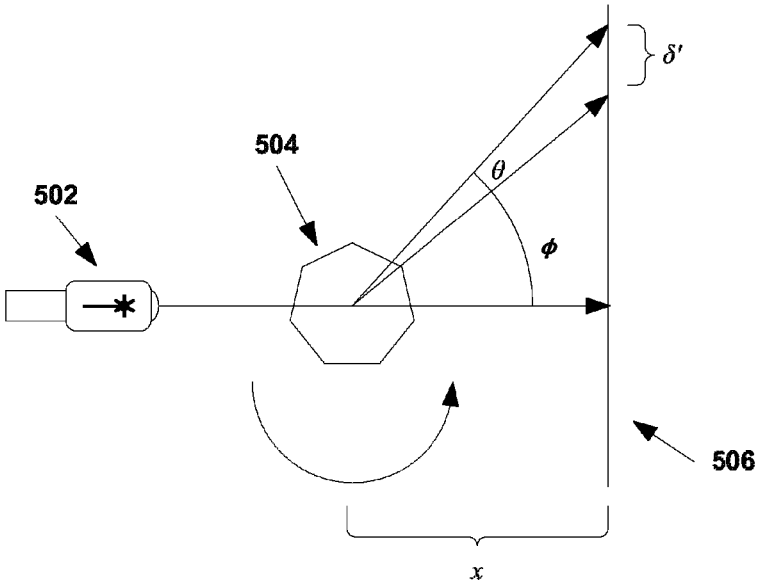
FIG. 5B (Prior Art)
FIG. 5B shows the spot size when the initial angular displacement is $\phi$.
Figure 5C:
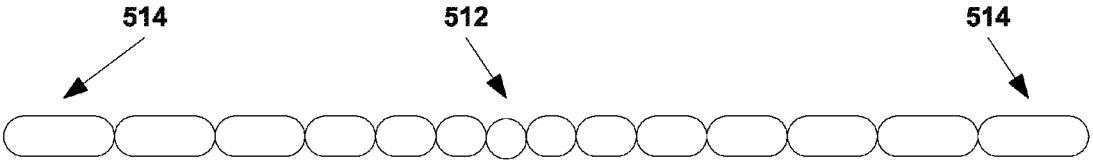
FIG. 5C (Prior Art)
FIG. 5C shows a plurality of dots as distorted by the constant angular velocity of the mirror.

Embodiments for correcting for the elongation of dots near the periphery of a page as described in FIGS. 5A, 5B and 5C will now be described. The constant angular velocity of a polygonal mirror can lead to elongated dots near the periphery of a page compared to dots in the middle of the page. Referring back to FIG. 5A, the width of the dot δ near the middle is equal to x tan θ where x is the perpendicular distance from the polygonal mirror to the drum. The width of the dot δ' at an angle φ from perpendicular is x[tan(θ+φ)−tan φ]. After the following calculations, $$\delta' = x\left[\frac{\tan\theta + \tan\phi}{1 - \tan\theta\tan\phi} - \tan\phi\right]$$

$$\delta' = x\left[\frac{\tan\theta + \tan\phi}{1 - \tan\theta\tan\phi} - \frac{\tan\phi(1 - \tan\theta\tan\phi)}{1 - \tan\theta\tan\phi}\right]$$

$$\delta' = x\left[\frac{\tan\theta + \tan\phi - \tan\phi + \tan\theta\tan^2\phi}{1 - \tan\theta\tan\phi}\right]$$

$$\delta' = x\left[\frac{\tan\theta + \tan\theta\tan^2\phi}{1 - \tan\theta\tan\phi}\right]$$

$$\delta' = x\tan\theta\left[\frac{1 + \tan^2\phi}{1 - \tan\theta\tan\phi}\right] = \delta\left[\frac{1 + \tan^2\phi}{1 - \tan\theta\tan\phi}\right]$$

$$\delta' = \delta\left[\frac{1 + \frac{\sin^2\phi}{\cos^2\phi}}{1 - \tan\theta\tan\phi}\right]$$

$$\delta' = \delta\left[\frac{\frac{\sin^2\phi + \cos^2\phi}{\cos^2\phi}}{1 - \tan\theta\tan\phi}\right] = \delta\left[\frac{\sin^2\phi + \cos^2\phi}{\cos^2\phi(1 - \tan\theta\tan\phi)}\right]$$

$$\delta' = \delta\left[\frac{1}{\cos^2\phi - \tan\theta\tan\phi\cos^2\phi}\right]$$

$$\delta' = \delta\left[\frac{1}{\cos^2\phi - \tan\theta\sin\phi\cos\phi}\right]$$

the relationship between dot sizes becomes $\delta=\delta'[\cos^2\phi-\tan\theta\sin\phi\cos\phi]$, which can further be simplified to $$\delta = \frac{1}{2}\delta'[1 + \cos 2\phi - \tan\theta\sin 2\phi].$$

If the angle φ is not too close to 90° (which is there is usually some space between the mirror and the drum) the last term is small in comparison so $$\delta \approx \frac{1}{2}\delta'[1 + \cos 2\phi].$$

Because the dot size is small, $\theta \approx \tan\theta$, so $\delta \approx x\omega\Delta t$. To make the peripheral dots smaller, the dot period may be multiplied by $$\frac{1}{2}[1 + \cos 2\phi]$$

to compensate for the constant angular velocity.

Figure 24:
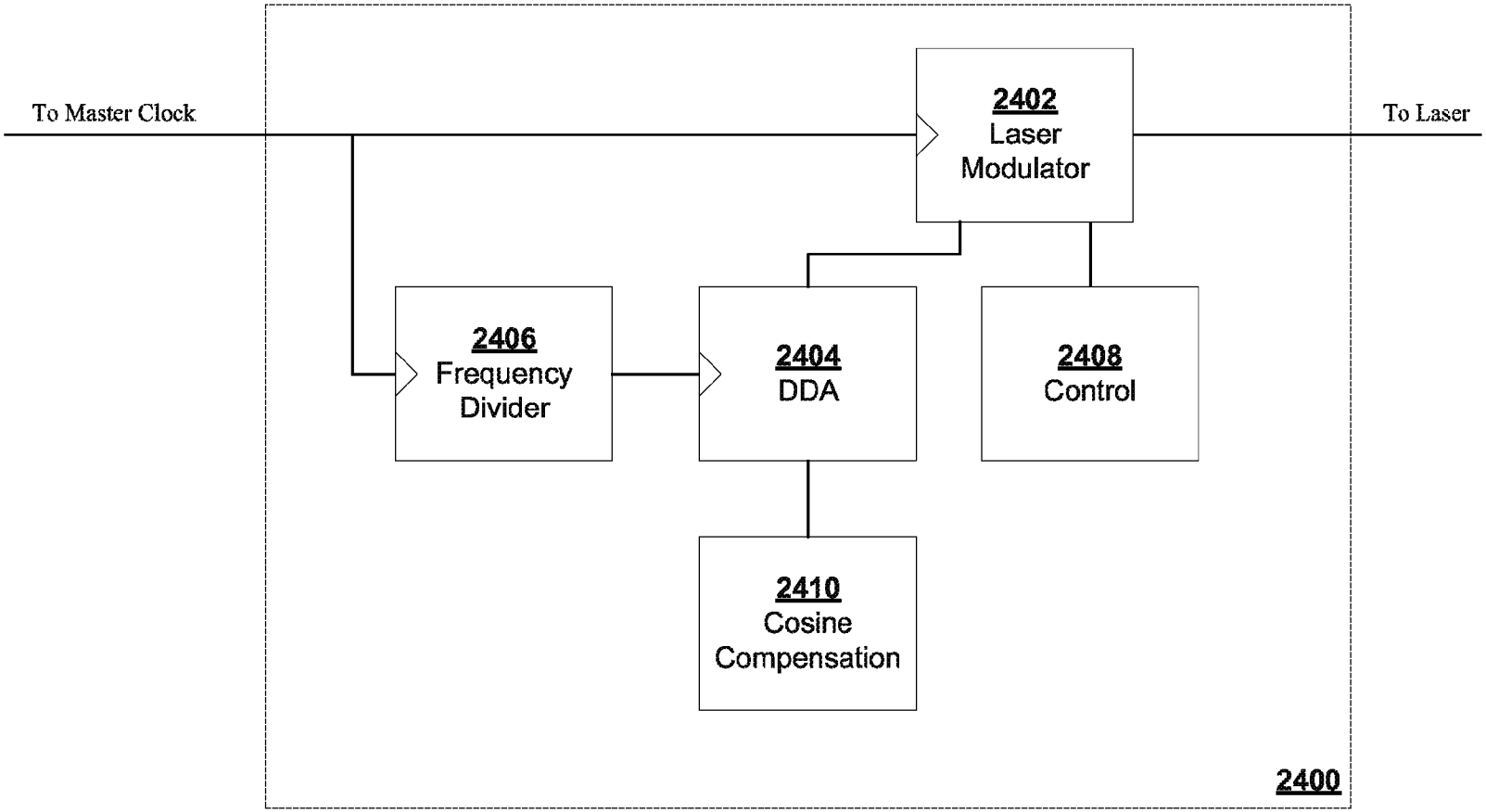
FIG. 24 illustrates an embodiment of a control circuit with compensation for cosine distortion.

FIG. 24 illustrates an embodiment of a control circuit with compensation for this cosine distortion. Control circuit 2400 includes a laser modulator 2402, frequency divider 2406, image control module 2408 and DDA 2404. Control circuit 2400 further comprises cosine compensation module 2410, which controls DDA 2404 and compensates for the cosine distortion by shortening the number of clock cycles for a dot period when the laser is near the edge of a line and increasing the number of clock cycles for a dot period near the middle of the page. By doing this, actual size of a dot on a page remains constant as the laser scans across a row.

Figure 25:
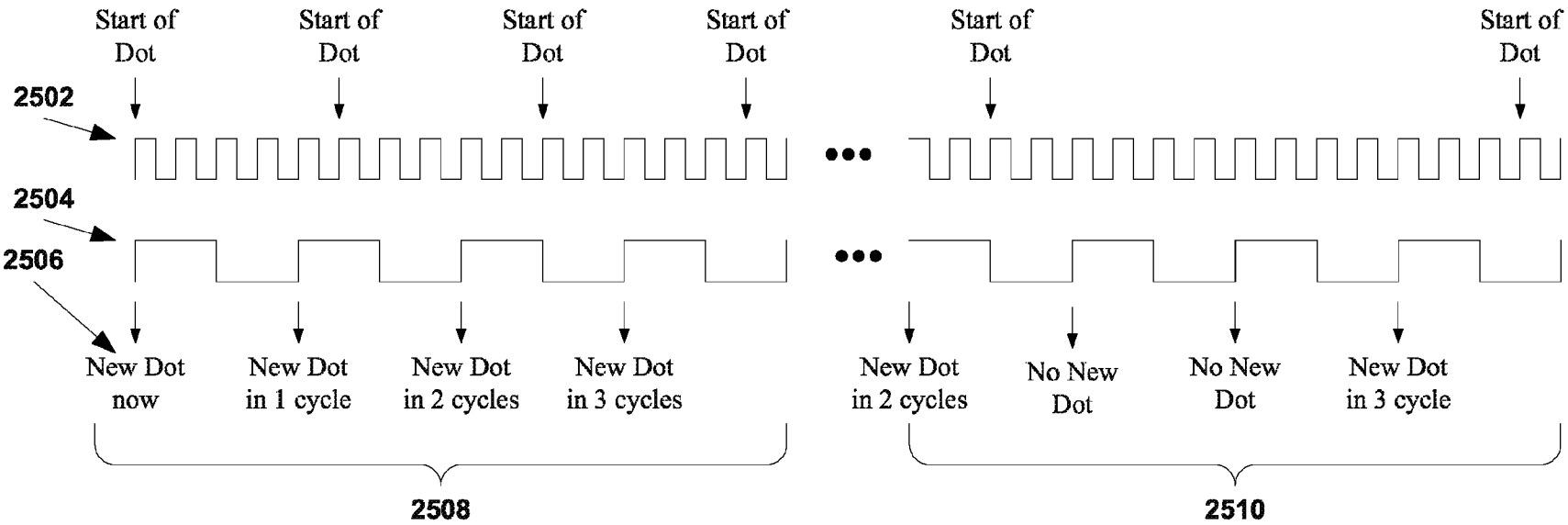
FIG. 25 is an embodiment of the timing and output of a DDA when controlled by a cosine compensation module.

FIG. 25 an example of the timing and output of the DDA 2404 when controlled by cosine compensation module 2410.

Master clock signal is shown as clock signal 2502. Signal 2504 is the signal clocking DDA 2404 which is the result of dividing down master clock signal 2502. Output 2506 is the output indication of DDA 2404. Because of the cosine compensation the dot period indicated by DDA 2404 is shorter when the laser starts its scan as represented by region 2508. In region 2510 which is closed to the center of the page, the dot period indicated by DDA 2404 is longer.

Figure 26:
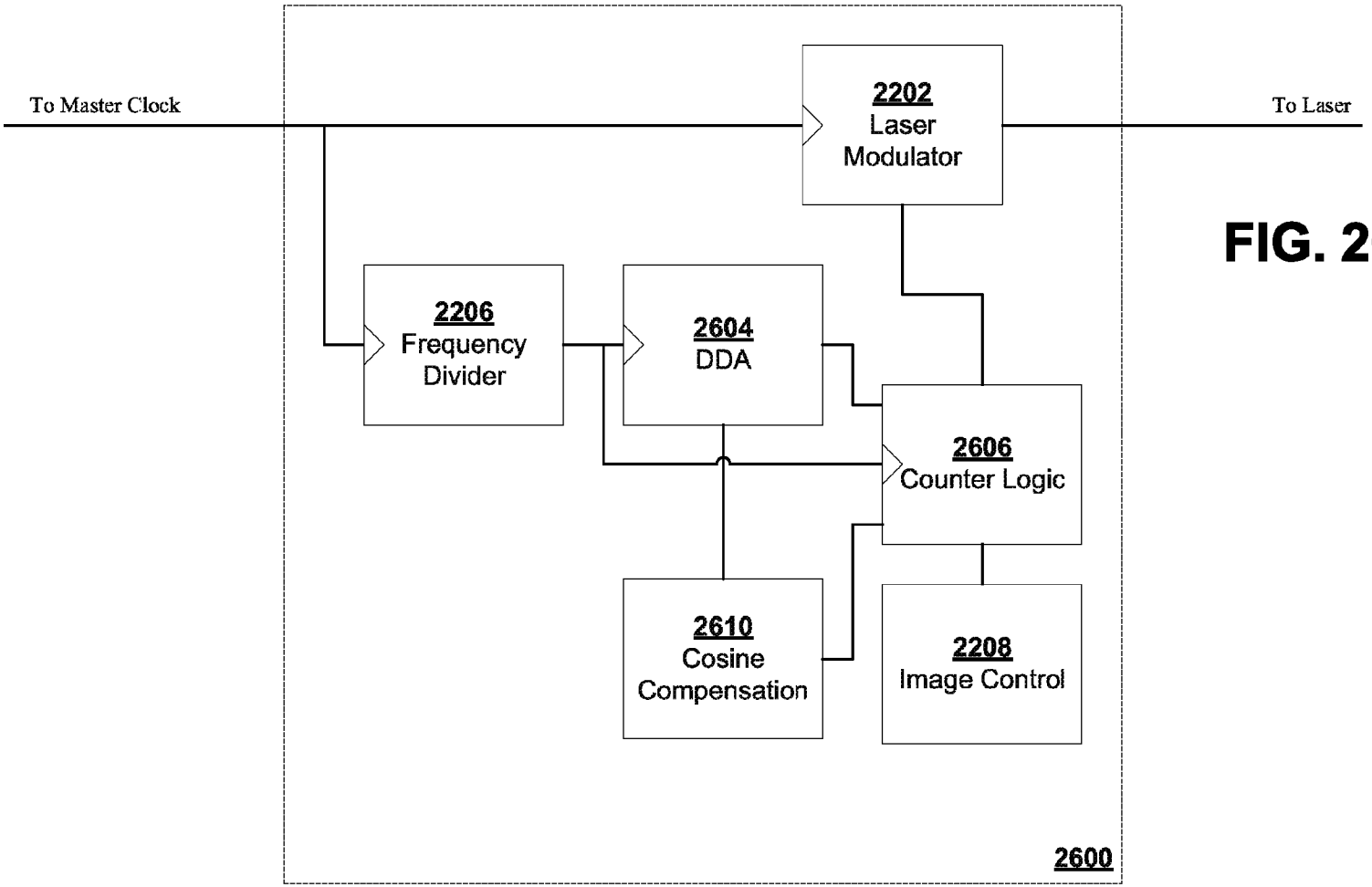
FIG. 26 shows an embodiment of a cosine compensated control circuit.

Even though the dot boundaries are distorted relative to the master clock signal when cosine distortion is compensated electronically (as opposed to optically with an aspherical lens), the image control module still operates the same way by indicating whether a dot should be written at a particular location. This embodiment can be extended to partial dot lengths and partial dot alignments as described for control circuit 2200. FIG. 26 shows a combination of the cosine compensation and control circuit 2200. The primary difference between control circuit 2200 and control circuit 2600 is cosine compensation module 2610 which controls DDA 2604 to produce dot periods of various widths in order to compensate for the cosine distortion that occurs from the constant angular velocity of the polygonal mirrors. Cosine compensation module 2610 also controls counter logic circuit 2606 so that counter logic circuit 2606 knows the number of master clock cycles that are present in a given partial dot—e.g., how many master clock cycles constitute ½ a dot or ¼ a dot at the current location on the drum. In this manner, counter logic circuit 2606 controls laser modulator 2202 to turn on or off at partial dot locations even when the partial dot sizes can vary due to cosine distortion.

The width of each dot can be either stored or calculated. For example, the widths can be stored in a lookup table or calculated as a piecewise linear, quadratic, cubic, or other approximation. However, consideration should be made for the computational time of these approaches. Another approach approximates the width with a polynomial approximation such as by using a Maclaurin series. If a polynomial approximation is used, a higher order DDA can be used. This higher order DDA can be a pipelined DDA with a programmable initial state or can be a lower speed DDA in a fashion similar to control circuit 1300. For simplicity of explanation, an implementation using a high order pipelined DDA is described.

Figure 27:
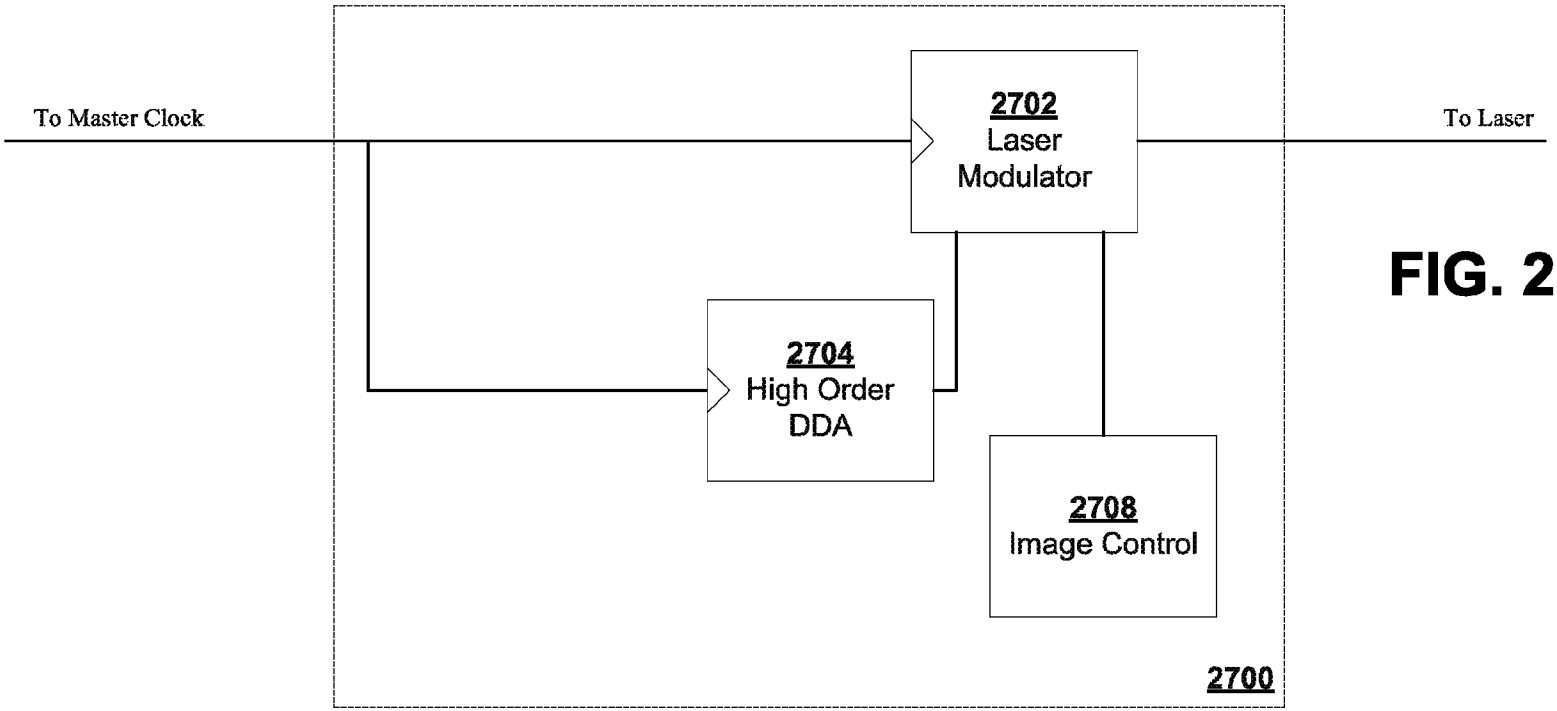
FIG. 27 shows an embodiment of a cosine compensated control circuit using a high order DDA.

FIG. 27 shows a cosine compensated control circuit 2700 using a high order DDA. When a start of line pulse is received, high order DDA 2704 is set to an initial state. DDA 2704 generates an indication of dot boundaries, however, unlike the previous examples, the widths of the dots are not uniform. Image control 2708 directs laser modulator 2702 whether to write a dot and DDA 2704 controls the width of the dots.

Figure 28:
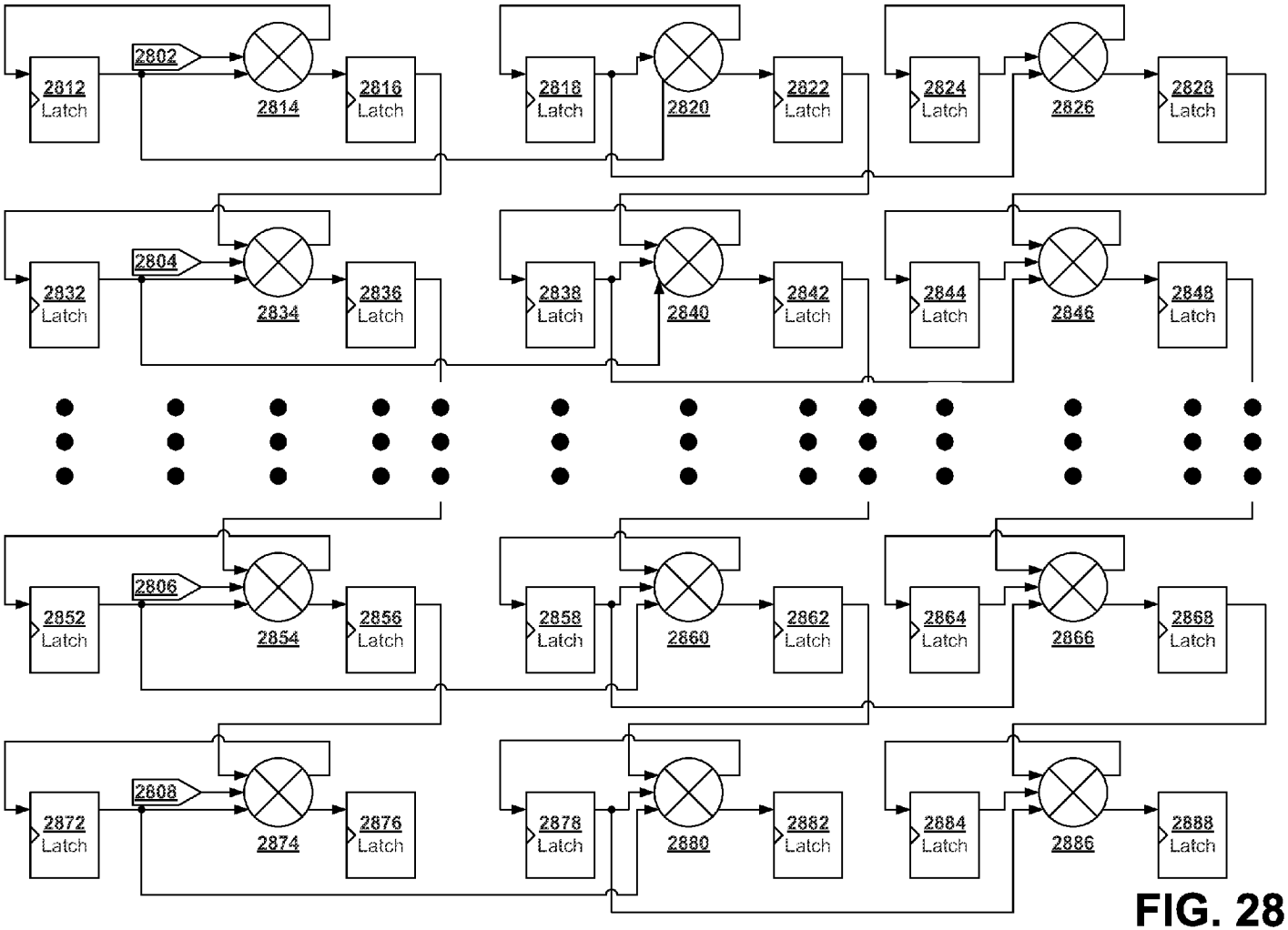
FIG. 28 illustrates an embodiment of a high speed pipelined high order DDA.

FIG. 28 illustrates a high speed pipelined high order DDA. In this example, three first order DDAs are depicted. For simplicity, clock signal lines are not shown. The first order DDA is connects the input to the adding component (such as signal 914 in FIG. 9) to the sum bit of the adjacent first order DDA. This is shown in the right two first order DDAs in FIG. 28, where the latch sum bit of stored by latch 2822 is fed to adding component 2826. The order of the DDA is expanded by adding first order DDAs connected in the same fashion. This design for an $n^{th}$ order DDA can be used to perform an $n^{th}$ order polynomial approximation, if the initial conditions for the sum bit latches (e.g., latches 2812, 2818, 2824, 2832, 2838, 2848, 2852, 2858, 2864, 2872, 2878, and 2784) are set appropriately and the carry bit latches (e.g., latches 2816, 2822, 2828, 2836, 2842, 2848, 2856, 2862, 2868, 2876, 2882, and 2888) are reset on initialization.

Another consideration when compensating for cosine distortion is that the exposure time of the laser on the drum will vary. Dots at the edge of a line will experience the laser for shorter time than dots in the middle of the line. As a result less energy is delivered to dots at the periphery than in the middle of the line. If the energy is diminished too greatly, the laser may not discharge the drum so that toner will not adhere to the drum. In contrast, if the laser power were increased to deliver sufficient energy to discharge the drum at the periphery of the line, the intensity of the laser may be too great for the center of the drum resulting a reduced lifetime to the components.

In addition to correcting for the width of the dot, the cosine compensation module can supply a power adjustment to the laser modulator. In one power model, the amount of energy received at the drum is equal to the power times the exposure time. For example, to maintain the constant width of a dot at a given position on the periphery, the laser may be on ¼ as long as a dot in the middle of a line. To delivery sufficient energy, the laser would have to be 4 times as powerful. Hence, there is a relationship between the width and the power adjustment necessary. If the adjustment to the cosine distortion is already calculated a simple calculation can yield an appropriate power adjustment.

It may be possible that the simple power model given above is not accurate enough for certain implementations. Even though the energy delivered to the drum is equal to the power and the exposure time of a dot, the amount of energy required to discharge the dot on the drum may not be independent of the power of the laser. For example, because the exposure is so short, it may take more energy to discharge a spot on the drum, requiring even more power to be delivered at the periphery than in the middle. In this case, the cosine compensation module would have to either calculate power adjustment values or retrieve pre-stored adjustment values and deliver them to the laser modulator along with instructions on when to start and stop the laser.

In an actual implementations the number of laser scanning units may vary. There may be one laser scanning unit for a monochrome printer, two laser scanning units for a monochrome duplex printer which prints both sides simultaneously, four laser scanning units for a CYMK printer or even eight laser scanning unit for a duplex CYMK printer. Each laser scanning unit can be driven by a corresponding control circuit. These control circuits can reside on the same semiconductor chip or can reside on several semiconductor chips. Due to the high speed operation of the master clock, it is typical to share the master clock with control circuits on the same chip. For example a four color laser printer may have two semiconductor chips each comprising a master clock and two control circuits associated with each of two laser scanning units.

It should be emphasized that the above-described embodiments are merely examples of possible implementations. Many variations and modifications may be made to the above-described embodiments without departing from the principles of the present disclosure. For instance, the embodiments described above use distinct laser scanning units as examples, but the principles also apply to systems where the laser scanning units share components such as the polygonal mirror. All such modifications and variations are intended to be included herein within the scope of this disclosure and protected by the following claims.

What is claimed:

1. An engine controller for driving a laser engine comprising:

a master clock generating a master clock signal comprising a plurality of master clock cycles;

a laser modulator operable to receive the master clock signal and produce a signal to instruct the laser engine to produce a dot;

a digital differential analyzer (DDA) operable to receive a clock signal and to indicate a dot width by signaling to the laser modulator dot position boundaries for positions where dots may be written; and an image control circuit operable to control the laser modulator, wherein the image control circuit indicates whether a dot should be written at a given position.

2. The engine controller of claim 1 wherein the clock signal is the master clock signal.

3. The engine controller of claim 1 further comprising:

a frequency divider coupled to the master clock signal to generate a slow clock signal comprising a plurality of slow clock cycles;

wherein the clock signal is the slow clock signal and the DDA signals dot boundaries to the laser modulator by indicating after which master clock cycle a given dot boundary occurs during the current slow clock cycle.

4. The engine controller of 1 further comprising:

a counter logic circuit operable to signal the laser modulator whether to turn a laser on or off by indicating the number of master clock cycles in a given fraction of a dot.

5. The engine controller of 1 wherein the DDA counts the number of master clock cycles in a dot period.

6. The engine controller of 1 wherein the DDA is a pipelined first order DDA.

7. A laser printer comprising:

a laser engine comprising a plurality of laser scanning units, each scanning unit having a corresponding color;

a master clock generating a master clock signal comprising a plurality of master clock cycles;

an engine controller driving the laser scanning units and comprising:

a plurality of laser modulators each associated with a laser scanning units in the plurality of laser scanning units and each operable to receive the master clock signal and produce a signal to instruct the laser engine to produce a dot each associated with the corresponding color;

a plurality of DDAs each associated with a laser modulator in the plurality of laser modulators and each operable to receive a clock signal and to indicate a dot width by signaling to said laser modulator dot position boundaries for positions where dots may be written; and a plurality of image control circuits each associated with a laser modulator in the plurality of laser modulators and each operable to control said laser modulator.

8. The laser printer of claim 7 wherein the clock signal is the master clock signal.

9. The laser printer of claim 7 further comprising:

a frequency divider coupled to the master clock signal to generate a slow clock signal comprising a plurality of slow clock cycles;

wherein the clock signal is the slow clock signal and each DDA signals dot boundaries to the laser modulator by indicating after which master clock cycle a given dot boundary occurs during the current slow clock cycle.

10. The engine controller of 7, wherein the engine controller further comprises:

a plurality of counter logic circuits each associated with a laser modulator in the plurality of laser modulators and each operable to signal said laser modulator whether to turn a laser on or off by indicating the number of master clock cycles in a given fraction of a dot.

11. The engine controller of 7 wherein each DDA counts the number of master clock cycles in a dot period.

12. The engine controller of 7 wherein each DDA is a pipelined first order DDA.

13. The laser printer of claim 7 wherein the plurality of laser scanning units comprises:

a laser scanning unit corresponding to cyan;

a laser scanning unit corresponding to magenta;

a laser scanning unit corresponding to yellow; and a laser scanning unit corresponding to black.

14. A method of indicating a dot width comprising:

receiving a master clock signal having a sequence of cycles at a digital differential analyzer (DDA);

counting, using the DDA, the cycles of the master clock signal;

indicating a dot width by signaling with the DDA a dot position boundary when the number of cycles of the master clock signal reaches a predetermined number.

15. The method of claim 14 wherein the counting of cycles occurs every n cycles of the master clock and wherein the indicating a dot position boundary comprises determining after which cycle of the master clock a dot position boundary occurs in the next n cycles of the master clock.

16. The method of claim 14 further comprising waiting for a start of line pulse before beginning the counting of cycles.

17. An engine controller for driving a laser engine comprising:

a frequency divider comprising:

an XOR gate having inputs and an output;

a latch driven by a master clock signal configured to latch the output of the XOR gate; and a pipelined DDA having an input value;

wherein the inputs of the XOR gate are coupled to the pipelined DDA;

wherein the pipelined DDA comprises:

a plurality of stages each comprising a latch driven by the master clock signal, an adder and a pipeline latch driven by the master clock signal, wherein the pipeline latch latches a carry output of the adder and is coupled to the adder of a subsequent stage; and wherein the input value is equal to $2^s$ divided by a divide down factor, where s is the number of stages in the DDA.

18. The engine controller of claim 17 further comprising:

a master clock generating a master clock signal comprising a plurality of master clock cycles;

a laser modulator operable to receive the master clock signal and produce a signal to instruct the laser engine to produce a dot;

a control circuit operable to control the laser modulator and receive the output of the XOR gate, wherein the output of the XOR gate has a frequency essentially equal to a desired dot clock frequency.

19. The engine controller of claim 18 further comprising a second frequency divider operable to receive a master clock signal and generate a slow clock signal;

a second laser modulator operable to receive the master clock signal and produce a signal to instruct the laser engine to produce a second dot;

a second control circuit operable to control the second laser modulator and receive the slow clock signal;

wherein the slow clock signal has a frequency essentially equal to a second desired dot clock frequency.

20. The engine controller of claim 19 wherein the desired dot clock frequency is a function of the distance from a first polygonal mirror to a drum and the second desired dot clock frequency is a function of the distance from a second polygonal mirror to a drum.

21. An engine controller for driving a laser engine comprising:

a master clock generating a master clock signal comprising a plurality of master clock cycles;

a laser modulator operable to receive the master clock signal and produce a signal to instruct the laser engine to produce a dot;

an image control circuit operable to control the laser modulator;

a digital differential analyzer (DDA) operable to receive a clock signal and signal dot boundaries to the laser modulator; and a counter logic circuit operable to signal the laser modulator whether to turn a laser on or off by indicating the number of master clock cycles in a given fraction of a dot.

22. An engine controller for driving a laser engine comprising:

a master clock generating a master clock signal comprising a plurality of master clock cycles;

a laser modulator operable to receive the master clock signal and produce a signal to instruct the laser engine to produce a dot;

an image control circuit operable to control the laser modulator; and a digital differential analyzer (DDA) operable to receive a clock signal and signal dot boundaries to the laser modulator, wherein the DDA is a pipelined first order DDA.

* * * * *